US012104593B2

(12) United States Patent
Ryma

(10) Patent No.: US 12,104,593 B2
(45) Date of Patent: Oct. 1, 2024

(54) SCROLL COMPRESSOR OF AN ELECTRICAL REFRIGERANT DRIVE AND ELECTRICAL REFRIGERANT DRIVE

(71) Applicant: Brose Fahrzeugteile SE & Co. Kommanditgesellschaft, Würzburg, Würzburg (DE)

(72) Inventor: Dennis Ryma, Rottendorf (DE)

(73) Assignee: Brose Fahrzeugteile SE & Co. Kommanditgesellschaft, Würzburg, Würzburg (DE)

( * ) Notice: Subject to any disclaimer, the term of this patent is extended or adjusted under 35 U.S.C. 154(b) by 0 days.

(21) Appl. No.: 17/986,099

(22) Filed: Nov. 14, 2022

(65) Prior Publication Data

US 2023/0074153 A1 Mar. 9, 2023

Related U.S. Application Data

(63) Continuation of application No. PCT/EP2021/057475, filed on Mar. 23, 2021.

(30) Foreign Application Priority Data

May 14, 2020 (DE) ..... 10 2020 206 106.8
Aug. 18, 2020 (DE) ..... 10 2020 210 452.2

(51) Int. Cl.
*F04C 18/02* (2006.01)
*F04C 27/00* (2006.01)
*F04C 29/00* (2006.01)

(52) U.S. Cl.
CPC ..... *F04C 18/0215* (2013.01); *F04C 18/0261* (2013.01); *F04C 18/0292* (2013.01); *F04C 27/005* (2013.01); *F04C 29/0021* (2013.01)

(58) Field of Classification Search
CPC ..... F04C 18/0215; F04C 18/0261; F04C 18/0292; F04C 27/005; F04C 29/0021
See application file for complete search history.

(56) References Cited

U.S. PATENT DOCUMENTS 9,945,380 B2 4/2018 Schneider et al.
10,801,496 B2 10/2020 Obrist et al.
(Continued)

FOREIGN PATENT DOCUMENTS

CN 105805001 A 7/2016
DE 19642798 A1 11/1997
(Continued)

*Primary Examiner* — Mary Davis
(74) *Attorney, Agent, or Firm* — Laurence A. Greenberg; Werner H. Stemer; Ralph E. Locher

(57) ABSTRACT

A scroll compressor of an electrical refrigerant drive contains a housing having a low-pressure chamber, a high-pressure chamber, compression chambers and a counter-pressure chamber. A stationary scroll has a base plate and a spiral wall, the base plate of the stationary scroll delimits the high-pressure chamber. A movable scroll has a base plate and a spiral wall which engages into the spiral wall of the stationary scroll and forms the compression chambers with the spiral wall. The base plate of the movable scroll delimits the counter-pressure chamber. A first fluidic connection is provided which connects the counter-pressure chamber to the radially innermost compression chamber, and the first fluidic connection is located in a positioning region of the radially innermost compression chamber between 75° to 195° following the merge angle.

10 Claims, 14 Drawing Sheets

(56) References Cited

U.S. PATENT DOCUMENTS

| | | | | |
|---|---|---|---|---|
| 11,131,306 | B2 | 9/2021 | Obrist et al. | |
| 11,466,688 | B2 | 10/2022 | Kim et al. | |
| 2011/0243777 | A1 | 10/2011 | Ito et al. | |
| 2013/0121864 | A1* | 5/2013 | Jang | F04C 27/005 418/55.1 |
| 2014/0178232 | A1 | 6/2014 | Nagano et al. | |
| 2015/0104342 | A1 | 4/2015 | Yamazaki et al. | |
| 2017/0058900 | A1* | 3/2017 | Park | F04C 18/0215 |

FOREIGN PATENT DOCUMENTS

| | | | |
|---|---|---|---|
| DE | 102012104045 | A1 | 11/2013 |
| DE | 102017105175 | B3 | 8/2018 |
| DE | 102017110913 | B3 | 8/2018 |
| EP | 2369182 | A1 | 9/2011 |
| EP | 2474740 | A1 | 7/2012 |
| WO | 2019112159 | A1 | 6/2019 |

* cited by examiner

SCROLL COMPRESSOR OF AN ELECTRICAL REFRIGERANT DRIVE AND ELECTRICAL REFRIGERANT DRIVE

CROSS-REFERENCE TO RELATED APPLICATION

This application is a continuation, under 35 U.S.C. § 120, of copending International Patent Application PCT/EP2021/057475, filed Mar. 23, 2021, which designated the United States; this application also claims the priority, under 35 U.S.C. § 119, of German Patent Applications DE 10 2020 206 106.8, filed May 14, 2020 and DE 10 2020 210 452.2, filed Aug. 18, 2020; the prior applications are herewith incorporated by reference in their entirety.

FIELD AND BACKGROUND OF THE INVENTION

The invention concerns the field of positive-displacement machines using the spiral principle and relates to a scroll compressor of an electrical refrigerant drive, in particular a refrigerant compressor for refrigerants of a vehicle air-conditioning system. The invention furthermore relates to an electrical refrigerant drive having such a scroll compressor.

Air-conditioning systems, which air-condition the interior of a vehicle with the aid of a system forming a refrigerant circuit, are routinely installed in motor vehicles. Such systems in principle have a circuit through which a refrigerant passes. The refrigerant, for example R-134a (1,1,1,2-tetrafluoroethane) or R-744 (carbon dioxide) is heated at an evaporator and compressed by means of a (refrigerant) compressor, wherein the refrigerant then releases the absorbed heat again via a heat exchanger before it passes back to the compressor via a choke.

Scroll technology is often used for the refrigerant compressor in order to compress a refrigerant/oil mixture. The gas/oil mixture created here is separated, wherein the separated gas is introduced into the air-conditioning circuit while the separated oil may be passed onward to moving parts inside the scroll compressor as a refrigerant compressor driven in a suitable manner by an electromotor in order to lubricate them.

Essential constituents of the scroll compressor are a stationary or fixed scroll (stator scroll) and a movable, orbiting scroll (rotor scroll, positive-displacement scroll). Both scrolls (scroll parts) have the same fundamental structure and each have a base plate and a spiral-shaped wall (wrap) which extends in an axial direction from the base plate and will be referred to below also as a spiral wall. In the assembled state, the spiral walls of the two scrolls lie nested inside each other and form a plurality of compressor chambers between the scroll walls which touch each other in places.

When the movable scroll performs an orbiting movement, the drawn-in gas/oil mixture passes via an inlet from a low-pressure chamber to a first, radially outer compressor chamber (suction chamber) and from there via further compressor chambers (compression chambers) to the radially innermost compressor chamber (discharge chamber, outlet chamber) and from there via a central outlet opening into an outlet or high-pressure chamber. The chamber volume in the compressor chambers reduces from outside to in radially and the pressure of the increasingly compressed medium becomes higher. During the operation of the scroll compressor, the pressure in the compressor chambers thus increases from outside to in radially.

During the operation of the scroll compressor, because of the pressure generated in the compressor chambers and the axial force caused as a result, the movable and fixed scrolls are pressed apart in an axial direction such that a gap and hence leakages between the compressor chambers can occur. In order to avoid this as far as possible, the orbiting scroll is pressed against the fixed scroll, possibly in addition to an oil film between the friction surfaces of the two scrolls. The corresponding axial force (counteracting force) is generated by a receiving or pressure space (back pressure chamber), in which a specific pressure is generated, being provided on the rear of the base plate of the orbiting scroll.

The resulting axial force of the back pressure chamber is preferably greater than the sum of the individual axial force components of all the compressor chambers. A necessary compromise here, however, is that the axial force of the back pressure chamber cannot be dimensioned to be too great because otherwise friction losses and wear of the spiral walls increase significantly. The back pressure system is thus decisive for the performance and capacity of a scroll compressor.

If the back pressure system is not capable of building up a sufficiently high pressure in the back pressure chamber, this causes the scroll parts to become detached axially. As a result, axial gaps occur and a leak begins in the radial direction from the radially inner chambers to the radially outer chambers. As a result, the compression of the refrigerant is negatively influenced and operation in such working points is impossible or not possible efficiently.

Adaptive adjustment of the back pressure level can be implemented, for example, by flow-regulating components. Non-return ball valves, orifices, or nozzles, by means of which pressure equalization between the high-pressure chamber and the back pressure chamber is controlled and/or regulated, are, for example, provided for this purpose. The additional components entail, however, increased expenditure and greater mounting complexity in the production of the scroll compressor.

It is known, for example, from published, non-prosecuted German patent application DE 10 2012 104 045 A1, corresponding to U.S. Pat. No. 9,945,380, that a fluid connection is introduced in the base plate of the orbiting scroll at a specific position as a medium pressure duct (through hole, opening, back pressure port) and connects at least one of the compressor chambers formed by the scrolls to the back pressure chamber such that refrigerant gas from the compression process passes between the scroll spirals directly into the back or medium pressure chamber. By virtue of the medium pressure duct in the movable scroll connected to the back pressure chamber, the movable scroll is pressed in a self-adjusting (automatic) fashion against the fixed scroll such that a certain sealing effect (axial sealing effect) is produced. Alternatively, the medium pressure duct can be arranged in the fixed scroll and be routed around the movable scroll to the back or medium pressure chamber. The back pressure chamber is here connected to an oil suction duct introduced into the motor shaft and by a further fluid connection to the high-pressure chamber. A relatively high back pressure is generated in operation by the connection of the back pressure chamber to the high-pressure side, as a result of which, for example, the operation of a heat pump of the positive-displacement machine is disadvantageously influenced or becomes impossible.

German patent DE 10 2017 110 913 B3, corresponding to U.S. Pat. No. 11,131,306, discloses a back pressure system with a fluid connection between the back pressure chamber and a compressor chamber, and with a fluid connection from the high-pressure chamber to the back pressure chamber. The fluid connection from the high-pressure chamber to the back pressure chamber is here arranged fluidically behind an oil separator of the high-pressure chamber such that only refrigerant and no oil is to be returned into the back pressure chamber. As a result, bearings, such as for example a bearing for the motor shaft, are not lubricated inside the back pressure chamber, as a result of which their lifetime is disadvantageously reduced.

Depending on the positioning of the medium pressure duct (back pressure port), in the known scroll compressor the pressure in the back pressure chamber increases, in the case of a pressure ratio of, for example, 3 bar (low pressure) to 25 bar (high pressure), to for example approximately 6 bar to approximately 9 bar. In the known refrigerant scroll compressor for a motor vehicle air-conditioning system, the medium pressure duct is positioned at approximately 405°, starting from the start of the scroll spiral (spiral wall) of the movable (orbiting) scroll.

In the publication "Computer Modeling of Scroll Compressor with Self Adjusting Back-Pressure Mechanism", Tojo et al., Purdue e-Pubs (Purdue University), International Compressor Engineering Conference, 1986, a model for calculating the self-adjusting back-pressure mechanism in a scroll compressor is described. The results of the investigation in FIG. 12 of this publication indicate a range of the relative compressor chamber volume within which the back pressure port (at different port diameters) should be open (fluidically connected). This range is situated between 55% and approximately 100% of the (relative) chamber volume.

In "A Scroll Compressor for Air Conditioners", Tojo et al., Purdue e-Pubs (Purdue University), International Compressor Engineering Conference, 1984, virtually the same P-V diagram is shown in FIG. 11, wherein the range of the relative compressor chamber volume within which the back pressure port should be open, here lies between 55% and approximately 95%.

In both P-V diagrams, a (relative) pressure drop or pressure rise by a factor of 2 (from 2.0 to 1.0 or from 1.0 to 2.0) can be seen within the volume range under consideration. The starting value for the opening of the back pressure port is thus at approximately 100% or approximately 95% of the relative compressor chamber volume.

In "Computer Modeling of Scroll Compressor with Self Adjusting Back-Pressure Mechanism", Tojo et al., Purdue e-Pubs (Purdue University), International Compressor Engineering Conference, 1986, FIG. 5 shows the curve of the relative compressor chamber volume as a function of the angle of rotation (roll or shaft angle theta, θ) of the orbiting scroll. The curve shown is divided into the suction process, which corresponds to the low-pressure range, the compression process, and the outlet process. In the case of the opening range, relative to the relative volume, of the port of between 55% and 100% or 95% from FIG. 12, this results in an angular range from 0° to 335° (for a 100% opening starting volume) or 0° to 300° (for a 95% opening starting volume) within which the port should be positioned.

In "Dynamics of Compliance Mechanisms in Scroll Compressors, Part 1: Axial Compliance", Nieter et al., Purdue e-Pubs (Purdue University), International Compressor Engineering Conference, 1990, the angular position of the back pressure port (FIGS. 7 and 8) is discussed. FIG. 3 and page 309, penultimate paragraph, penultimate sentence provide an angular range of 360° within which the back or medium pressure duct (back pressure port) should be positioned.

German patent DE 10 2017 105 175 B3, corresponding to U.S. Pat. No. 10,801,496, discloses a scroll compressor with an orbiting scroll into which two fluid connections are introduced. A third fluid connection from the high-pressure chamber to the back pressure chamber is furthermore implemented. The first fluid connection is here arranged in a central section of the scroll spiral, i.e. in a section between a radially inner spiral end and a radially outer spiral start, wherein the second fluid connection is arranged in the starting region. This means that the first fluid connection is arranged in a compressor chamber between the high-pressure chamber and the low-pressure chamber, wherein the second fluid connection is placed in such a way that it is arranged in the region of the low-pressure or suction chamber. The second fluid connection is situated inside the spiral contour of the scroll but, when the suction chambers are closed, is closed by the spiral wall of the fixed scroll such that the second fluid connection at essentially no time has a fluid connection to a compression chamber.

SUMMARY OF THE INVENTION

The object of the invention is to develop a positive-displacement machine using the spiral principle in such a way that the pressure in the back pressure chamber is advantageously self-adjustable. In particular, it is intended that a suitable and variable back pressure system enables optimally flexible and effective adjustment of the pressure in the back pressure chamber by virtue of different operating pressures. It is also intended that leaks between the compressor chambers are reduced to the maximum extent possible and friction losses between the fixed scroll and the orbiting scroll are avoided or at least minimized. The object of the invention is furthermore to provide a particularly suitable electrical refrigerant drive having such a scroll compressor.

With respect to the scroll compressor, the object is achieved according to the invention with the features of the independent scroll compressor claim and with respect to the refrigerant drive with the features of the independent refrigerant drive claim. Advantageous embodiments and developments are the subject of the dependent claims. The advantages and embodiments described for the scroll compressor can be transferred analogously also to the refrigerant drive, and vice versa.

With the foregoing and other objects in view there is provided, in accordance with the invention, a scroll compressor of an electrical refrigerant drive. The scroll compressor contains a housing having a low-pressure chamber, a high-pressure chamber, compressor chambers and a back pressure chamber. A fixed scroll is provided and has a base plate and a spiral wall, wherein the base plate of the fixed scroll delimits the high-pressure chamber. A movable scroll is further provided and has a base plate and a spiral wall engaging in the spiral wall of the fixed scroll and forms the compressor chambers with the fixed scroll. The base plate of the movable scroll delimits the back pressure chamber. A first fluid connection connects the back pressure chamber to a radially innermost compressor chamber of the compressor chambers which, in a course of a movement of the movable scroll, is coupled to the high-pressure chamber via the outlet opening. The first fluid connection is disposed in a positioning region of the radially innermost compressor chamber between 75° to 195° after a merge angle at which two of the compressor chambers merge to form the radially innermost compressor chamber.

The scroll compressor according to the invention is provided for an electrical refrigerant drive, in particular for an electrical refrigerant compressor, and is suitable and configured for it. The scroll compressor is here designed in particular for delivering and compressing refrigerant of a motor vehicle air-conditioning system. The scroll compressor can also take the form of, for example, an air compressor, wherein the delivered or compressed fluid is in particular air.

The scroll compressor has a (compressor) housing with a low-pressure chamber and with a high-pressure chamber and with compressor chambers (compression chambers) and with a back pressure chamber. The scroll furthermore has a fixed scroll and a movable (this means an orbiting (oscillating)) scroll, in the driven state, i.e. when in operation (compressor operation), which are accommodated preferably at least partially in the housing. The movable scroll is referred to below also as an orbiting scroll. The scrolls can also be rotating scrolls, so-called co-rotating scrolls, in which one scroll is driven centrally about an axis of rotation and drives the second eccentrically mounted scroll via a mechanical connection. The explanations below for movable and fixed scrolls here also apply analogously and correspondingly to such rotating scrolls.

The scrolls or scroll parts each have a base plate and a spiral wall (scroll spiral) extending essentially perpendicularly therefrom, wherein the in particular sickle-shaped compressor chambers are formed between the mutually engaged spiral walls of the two scrolls (scroll parts). The preferably essentially symmetrically formed spiral walls of the scroll parts here have, for example, in each case a spiral angle of approximately 720°. The base plate of the fixed scroll here delimits the high-pressure chamber, and the base plate of the movable scroll delimits the back pressure chamber.

Depending on the spiral length of the scroll, the scroll compressor has one, two, or more fluid connections by means of which the back pressure chamber is connected to the compressor chambers. Each fluid connection here connects a different compressor chamber to the back pressure chamber. The fluid connections can here be configured so that they are direct, i.e. connect the back pressure chamber directly to the respective compressor chamber, or at least are indirect. The fluid connections thus act during operation as pressure ducts or pressure lines (medium pressure ducts) via which the back pressure chamber communicates fluidically with the at least two compressor chambers.

The compressor chambers will also be distinguished below as suction chambers, compression chambers, and discharge chambers. For symmetrical scrolls, there is an even number of suction or compression chambers. Symmetrical means here that both spiral lengths, i.e. the length of the spiral walls of the fixed and orbiting scrolls, are essentially the same, i.e. that the spiral walls have essentially the same spiral angle. Symmetrical also means that the shape and the wall thickness or wall strength are the same or at least similar over the progression of the spiral.

The suction chambers are here open to the low-pressure side (suction side). As soon as the suction chambers are closed by the orbiting movement of the scroll, they become compression chambers, the sickle-shaped volume of which is compressed or reduced successively in the course of the orbiting movement toward the center of the spiral. The two radially innermost compression chambers are here referred to as discharge chambers. The discharge chambers interconnect or merge to form a common outlet chamber which delivers the compressed refrigerant via the outlet opening into the high-pressure chamber. The angular position in which the discharge chambers merge to form the outlet chamber is also referred to below as the merge angle. The angular position here relates in particular to an angular situation of a drive or motor shaft driving the movable scroll.

If there is a scroll structure in which no merging of the discharge chambers takes place, the merge angle is to be understood in particular as a shaft angle of the motor shaft of between 90° and 180° before the complete discharge of the innermost chamber or the innermost volume.

The fluid connections are introduced into the fixed scroll and/or into the movable scroll. The conjunction "and/or" should be understood here and below to mean that the features linked by means of this conjunction can be formed both together and as alternatives to each other. In other words, it is possible that the fluid connections are introduced only in the fixed scroll or only in the movable scroll or are divided up with some in the fixed scroll and some in the movable scroll.

According to the invention, a first fluid connection is arranged in the region of the radially innermost compressor chamber. The radially innermost compressor chamber is a compressor chamber which, in the course of the orbiting movement of the movable scroll, is coupled to the high-pressure chamber via an outlet opening, in particular via a main outlet (main outlet port). The radially innermost compressor chamber should therefore be understood to be the outlet chamber. The first fluid connection can here be introduced into the compressor chamber itself, i.e. into the base plates and/or the spiral walls, or into the outlet opening.

The first fluid connection is here arranged in a positioning region of the outlet chamber between 75° to 195°, i.e. between 90°±15° to 180°±15°, in particular between 90° to 180°, preferably approximately 180°, after the merge angle. The term "approximately" refers, in the case of a specified angle below, in particular to a certain angular range around the specified value of the angle, for example, to ±5°. For example, an angle of approximately 180° should be understood as 180°±5°, i.e. as an angular range of between 175° to 185°.

The positioning region is to be understood here and below in particular as the surface or silhouette or contour of the outlet chamber at an angular situation of 75° to 195° after the merge angle. This means that the outlet chamber has a first surface at 75° after the merge angle and that the outlet chamber has a second surface at 195° after the merge angle, wherein the second surface is smaller than the first surface. The first fluid connection is thus introduced into the fixed or into the movable scroll in such a way that it is arranged in the region of the first and/or second surface.

In the case of scroll compressors with spiral lengths of above 720°, in one suitable embodiment, a second fluid connection is arranged so that it is offset outward, starting from the first fluid connection, by a spiral angle of 320° to 400°, in particular by a spiral angle of approximately 360°. Preferably, starting from the first fluid connection, an additional (second) fluid connection is provided every 320° to 400° of spiral angle, in particular every 360° of spiral angle. It is thus appropriate that a fluid connection between the back pressure chamber and a compressor chamber is provided every 360° of spiral angle. A particularly suitable scroll compressor is formed as a result. In particular, a particularly flexible back pressure system is thus implemented which enables the optimum possible axial force compensation at every working point or in every operating state of the scroll compressor. Monitoring the whole course of the compression by means of the second fluid connection (s) makes it possible to monitor all the compression processes and phenomena (for example, back flow, re-expansion). As a result, an optimum back pressure level can be obtained for a specified positioning of the fluid connections.

The embodiments below relate in particular to a scroll compressor, the scrolls of which have at least a scroll length of 720°. The scroll compressor thus has at least two fluid connections which are introduced into the fixed and/or into the movable scroll and via which the back pressure chamber is connected to a number of different compressor chambers which corresponds to the number of fluid connections.

"Axial" or an "axial direction" are understood here and below to mean in particular a direction parallel (coaxial) to the longitudinal axis of the scroll compressor, i.e. perpendicular to the base plates. Correspondingly, "radial" or a "radial direction" are understood to mean in particular a direction, oriented perpendicularly (transversely) to the longitudinal axis, along a radius of the base plates or the scroll compressor. "Tangential" or a "tangential direction" are understood here and below to mean in particular a direction along the periphery of the scroll compressor or the spiral walls (peripheral direction, azimuthal direction), i.e. a direction perpendicular to the axial direction and to the radial direction.

The back pressure system thus has a combination of fluid connections of the back pressure chamber to the compression chambers between the scroll spirals. The scroll requires in theory at least three fluid connections (one central one in the region of the discharge or outlet chamber and two in the compression chambers for one compression path each). In the case of symmetrical or almost symmetrical scrolls, it is, however, possible to reduce the required number of fluid connections in the regions of the compression and discharge chambers to two because in (essentially) symmetrical scrolls the two compression paths perform the same compression. This is also referred to below as "utilizing the symmetry".

The first fluid connection is mainly positioned in the region of the outlet chamber. The first fluid connection is thus arranged inside the (radially) innermost compressor chamber from which the compressed fluid or the compressed refrigerant is discharged through the main outlet port into the high-pressure chamber. The subsequent (second) fluid connection takes place at a position which is situated at a spiral angle of 320° to 400° further out on the spiral. The fluid connection is thus situated in a region in which it produces a connection to the compression chambers.

During a compression cycle, both fluid connections are active in respective different compression regions. Depending on the high-pressure and low-pressure level, a specific back pressure is required to ensure the axial force compensation. Refrigerant mass flows (a refrigerant mass flow always also means a certain proportion of an oil mass flow) are conveyed into and out of the back pressure chamber through the two fluid connections. The propelling force is here the pressure difference between the compressor chambers and the back pressure chamber. If the pressure of a fluidically connected compressor chamber is less than the pressure in the back pressure chamber, refrigerant flows from the back pressure chamber into the compressor chamber, and vice versa.

In particular, essentially the whole compression cycle is actively fluidically connected to the back pressure chamber. The mass flow through the back pressure chamber can absolutely be considered as a loss or as a leak. This loss mass flow is at all times kept as small as possible, for which reason, when configured as bores, the fluid connections have dimensions in diameter ranges of less than one millimeter (<1 mm). The smaller the diameters with which the fluid connections are configured, the longer the time until the back pressure level converges toward a desired target value. When the system is considered in a stationary state, the same back pressure occurs at all times. A compromise between the loss mass flow and the speed of reaction of the back pressure system is therefore important here.

In a suitable embodiment, a weighting of the cross-sectional areas of the fluid connections, i.e. their flow or fluid diameters, is provided here because the axial surfaces of the compressor chambers have a different size. This means that the inner fluid connection always has a smaller diameter than the subsequent outer fluid connections. In other words, the diameters of the fluid connections are adapted to the respective axial surfaces of the fluidically connected compressor chambers.

Self-regulating and highly dynamic adjustment of the axial force compensation is enabled by the back pressure system of the at least two fluid connections. The back pressure system here makes it possible to set an optimal pressure level in the back pressure chamber by virtue of the fluid connections to the compressor chambers. An "optimal pressure level" is here understood in particular to be a back pressure level at which a compromise between the (axial) downforce which should prevent leakage by minimizing the gaps and friction losses which cause power losses and wear is most favorable. In other words, an "optimal pressure level" exists when the recorded compressor power for achieving a specific working point (with the same boundary conditions) reaches its minimum.

In contrast to the prior art, this pressure level can be maintained in an optimal state by virtue of the arrangement of the fluid connections over all the working regions of the scroll compressor. Thus, for example in the case of back pressure systems according to the prior art which have access to the high-pressure chamber itself, it is only possible to set this optimally at working points when the air-conditioning (AC) is operating but not simultaneously also optimally at a working point during operation of the heat pump or when conditioning a vehicle battery of an electrically driven or drivable motor vehicle because these systems generally have too high a back pressure level at these working points.

The back pressure system furthermore has an increased efficiency by virtue of the energetically favorable fluid connections. In contrast to back pressure systems which have a fluid connection to the high-pressure chamber, the fluid or the refrigerant/oil mixture is removed directly from the compression chamber before it has been completely compressed. This is more favorable energetically than removing the refrigerant from the high-pressure chamber only after it has been completely compressed and then expanding it to the back pressure level. In addition, a lower gas temperature consequently results inside the back pressure chamber, as a result of which the load-bearing capacity and lifetime of bearings of the scroll compressor, in particular of a center plate bearing and of the bearing of the orbiting scroll, are improved.

An important point for a long lifetime of rolling or plain bearings is that they are lubricated. Two rolling bearings are generally situated inside the back pressure chamber. In other back pressure systems according to the prior art, the oil is intentionally separated inside an oil separator of the high-pressure chamber and returned via a separate path into the suction side or low-pressure chamber. Instead, in the back pressure system forced lubrication takes place through the fluid connections. Oil at a lower temperature is also used here for the lubrication compared with the prior art. An improved lubricating film for the bearing results because of the viscosity which is increased thereby.

A secondary oil circuit which ensures the lubrication by the oil/refrigerant mixture is created. Moreover, the oil is situated in a type of circuit and is also returned into the outer compression chamber where it effects additional sealing of the leakage gaps (both radially and axially). Furthermore, lubrication of the anti-rotation mechanism and all the other movable components inside the back pressure chamber is also improved. A particularly high degree of efficiency of the scroll compressor is ensured as a result.

Furthermore, it is not possible by means of the back pressure system that the orbiting scroll becomes detached from the fixed scroll during operation of the compressor. So-called detachment occurs in the case of compressors in which the back pressure system cannot supply a sufficient axial force compensation at each operating point (for example, heat pump points). The orbiting scroll here becomes axially separated from the fixed scroll. The compression is completely interrupted or extremely inefficient because of the leakage gaps which are created.

Such a detachment process is generally a self-reinforcing process. When the detachment begins during intact compression, refrigerant flows from the innermost compressor chamber into the subsequent outer compressor chambers because of the high-pressure differences, as a result of which the pressure in the compressor chambers rises. An even greater axial downforce from the back pressure chamber is required as a consequence. If this is not provided, the axial leakage gap becomes larger. This happens until the compression has come to a complete halt or at least certain compression conditions can no longer be achieved.

The radially outer fluid connection preferably has a larger diameter than the radially inner fluid connection, as a result of which increases in pressure due to leaks are corrected quickly. By virtue of the larger cross-sectional area of the radially outer fluid connection, the weighting for setting the back pressure is also higher than in the case of the radially inner fluid connection. A higher weighting is thus assigned to the leak, as a result of which "dynamic feedback" occurs and a detachment process of the scroll is prevented. Because the back pressure system monitors the whole compression process, it reacts adaptively to leaks which increase the pressure in the compressor chambers situated on the outside, wherein the at least one fluid connection situated on the outside consequently also increases the pressure level in the back pressure chamber. A particularly high speed of reaction of the back pressure system can be effected, for example, by direct fluid connections being introduced into the base plate of the orbiting scroll.

The fluid connections are preferably configured as bores of the fixed and/or movable scroll. As a result, in the back pressure system there is no need for additional flow-regulating components or post-processing or the introduction of other compressor components for producing the fluid connections. As a result, the back pressure system is implemented in a manner which is particularly simple in terms of its structure and means of production and in which no additional flow-regulating components are required.

The two scroll parts are preferably produced or at least post-processed by being machined from a solid blank. It is here possible to implement the introduction of the fluid connections directly in the production process, as a result of which no or only low additional costs are entailed in the production of the scroll compressor. The back pressure system here has an improved processing capability, as a result of which in particular mass production of the scroll compressor is improved.

The scroll compressor thus has a cost advantage because of the simple structure (reduced number of components) and a functional advantage in terms of efficiency, wear, and possible uses.

In one conceivable embodiment, more than two fluid connections are provided, wherein the second and each further fluid connection are arranged symmetrically relative to one another with respect to the spiral or the spiral angle. In other words, all the fluid connections which are not placed in the outlet region (i.e. in a discharge chamber or in the outlet chamber) are distributed symmetrically over the compression paths of the scroll compressor. Normally, a scroll has two more or less symmetrical compression paths which generate the same compression cycles. As a result, a second fluid connection which is positioned inside a compression chamber and has a certain flow cross-section can also be distributed symmetrically over both compression paths with in each case half the flow cross-section. Symmetrical recirculation of the loss mass flow is effected as a result. Such a symmetrical recirculation of the loss mass flow is in particular advantageous for a more uniform pressure distribution in the compressor chambers. In this symmetrical embodiment, the symmetry of the compression paths is thus not used in order to reduce the number of required fluid connections to two. This embodiment is therefore also suitable in particular for non-symmetrical scroll variants.

For example, at least one fluid connection is provided every or per 360° spiral angle. As a result, each compression chamber of the scroll spirals is constantly fluidically connected to the back pressure chamber such that, in the case of correct weighting of the connection diameter to the axial cross-sectional areas of the compression chambers, a back pressure results in the back pressure chamber which enables optimal axial force compensation.

In a structurally particularly simple and cost-effective embodiment, the fluid connections are configured as bores. In particular, the fluid connections are introduced as perpendicular or axial bores in the or each scroll. For example, the fluid connections are introduced into the base plate of the or each scroll.

In an advantageous development, the first fluid connection overlaps with the outlet opening at no time in the movement of the movable scroll. This means that when the first fluid connection is arranged in the movable scroll, the projection of the first fluid connection onto the base plate of the fixed scroll at no time intersects with, touches, sweeps across, or moves across the outlet opening. The first fluid connection thus has no overlap or intersection with the outlet opening. In other words, the first fluid connection is at no time arranged so that it is axially aligned with the outlet opening or a part of the outlet opening.

In a preferred embodiment, none of the fluid connections is coupled to the low-pressure chamber. In other words, no fluidic connection is provided in the region of the suction chambers. This means that the fluid connections are arranged exclusively in the inner regions of the scroll parts, i.e. in the region of the compression chambers, the discharge chambers, and the outlet chamber. As a result, the back pressure chamber has no connection to the suction side or to the low-pressure chamber. Loss mass flows in the scroll compressor are consequently reduced.

In contrast to back pressure systems which have a fluidic connection to the suction side, the refrigerant/oil mixture is returned directly into one of the outer compression chambers. As a result, complete expansion of the refrigerant from the back pressure level to the suction pressure level of the low-pressure chamber does not take place. Thus, in the case of the scroll compressor, there is no "complete loss" of the loss mass flow through the back pressure system because the whole mass flow is returned into the compressor chambers.

An additional or further aspect of the invention provides that the fluid connections are arranged in such a way that the fluid connections are at no time in the orbiting movement of the movable scroll collectively covered or closed. In other words, at least one fluid connection is open at any moment in time. It is consequently possible, when the scroll compressor is switched off, to effect a pressure equalization in the system or in the back pressure chamber. This means that the pressure in the back pressure chamber can also be reduced. Otherwise, when the scroll compressor is (re) started shortly afterwards, there is a high axial downforce which is not counteracted by the compression forces of the compressor chambers because no high pressure has yet built up in the refrigerant circuit of the vehicle air-conditioning system. The consequence is increased wear of the axial contact surfaces and a high "breakaway torque" which needs to be applied by the drive of the scroll compressor.

In an additional or alternative design, the fluid connections are introduced into the or each spiral wall.

The fluid connections are introduced, for example, into the radial flanks of the scroll spirals or the spiral walls. This is possible because the compressor chambers have both radial walls (spiral walls) and axial walls (base plates), all of which have the same pressure applied to them. The difference here, however, is that, in the course of the orbiting movement, the radial fluid connections would be covered by the respective other spiral wall for a much shorter period of time than axially oriented fluid connections in the base plate.

In an advantageous embodiment, one of the spiral walls has a stepped axial offset, wherein a fluid connection is introduced in the region of the offset. In a suitable embodiment, the spiral wall is in particular the spiral wall of the movable or orbiting scroll.

The stepped axial offset is here preferably configured as a so-called tip cut or wave guide of the spiral wall. A tip cut is here understood to be a step on the radially inner spiral wall end which effects a premature, damped merging of the compressor or discharge chambers. In a particularly suitable embodiment, the innermost or first fluid connection is introduced into the tip cut. A wave guide is to be understood here as a step which is offset or spaced apart from the radially inner spiral wall end in the curve of the spiral wall. At no time in the operation of the compressor or the orbiting movement does a spiral flank or spiral wall move across the tip cut or wave guide and the latter is therefore never closed. In other words, the fluid connection is always open. This prevents particles from being pushed in when there is movement across the fluid connection.

An additional or further aspect of the invention provides that the or each fluid connection is provided with a filter component. The filter components are provided here to improve the robustness against particles, in particular in the case of fluid connections with a small diameter, and are suitable and configured for this.

The ratios of the flow cross-sections of the fluid connections are variable to a small extent. However, a certain minimum size or a certain minimum diameter is necessary if simple bores are used as a fluid connection The reason for this is that a certain speed of reaction of the back pressure system is required, depending on the filling speed of the back pressure chamber. Furthermore, a certain particle resistance should be achieved. This means that the smallest particles cannot directly clog up or block the bore or fluid connection. In the automotive sector, particle sizes of up to 200 μm (micrometers) are generally permissible.

The smaller the dimensions of the flow diameters of the fluid connections, the lower too the drop in the loss mass flow. By using fine filter fabrics (for example, Betamesh with a 40 μm mesh size) inside the fluid connections, it is also possible to use very fine fluid connections, i.e. fluid connections with a small diameter, for example in the region of approximately 0.1 mm.

Additionally or alternatively, it is possible, for example, to introduce a combination part consisting of a filter and choke geometry into the scroll components in order to improve the robustness against particle clogging. As a result, smaller flow cross-sections can be achieved without increasing the risk of clogging. This ensures operation in general applications and degrees of pollution which are customary in motor vehicles.

In a particularly suitable embodiment, the first fluid connection is introduced into the fixed scroll. As a result, the first fluid connection is never closed during the operation of the compressor such that a connection to the back pressure chamber is always effected.

In a preferred embodiment, the first fluid connection is here Introduced transversely or obliquely into the outlet opening or into an inner wall of the outlet opening. The risk of soiling or blockages in the first fluid connection is thus advantageously reduced.

The fixed scroll has, for example, in addition to the central outlet opening (main outlet port), further outlet openings which are radially spaced apart therefrom and which are also referred to below as secondary valve ports. The outlet openings, i.e. the main outlet and the secondary valve ports, are, for example, covered or can be covered by a flapper valve. The secondary valve ports thus interact with the flapper valve as pre-outlet valves or auxiliary outlet valves, by means of which over-compression of the refrigerant during operation of the compressor is avoided. It is conceivable here, for example, that the first fluid connection is introduced into the main outlet port and the second fluid connection is introduced into a secondary valve or secondary outlet port of the fixed scroll.

In a structurally particularly simple embodiment, all of the fluid connections are introduced in one of the scrolls. In other words, the fluid connections are arranged exclusively in one of the scroll parts. The fluid connections are here preferably introduced into the orbiting scroll. This ensures that the fluid connections are produced together or essentially at the same time, as a result of which manufacturing tolerances and thus loss mass flows are reduced.

In order to reduce loss mass flows, the aim is generally to make the dimensions of the flow cross-sections of the fluid connections as small as possible. The fluid connections are here preferably produced together in order to reduce deviations due to manufacturing tolerances as much as possible. If, for example, two fluid connections are configured as bores and the bores are in the region of 0.3 mm (millimeters) and for this purpose have a manufacturing tolerance of 0.03 mm, this results in a tolerance range of 10%. If two fluid connections are manufactured at the same time, it can be assumed that a bore deviation is in the same direction and does not vary significantly. In the case of two separately manufactured components, one fluid connection could, for example, have a diameter of 0.27 mm and the other a diameter of 0.33 mm. Based on the cross-sectional area (0.05726 $mm^2$ and 0.08553 $mm^2$), in the worst-case scenario a deviation of (0.05726 $mm^2$/0.08553 $mm^2$=0.67) 33% would result. As a result, the pressure level in the back pressure chamber could be subject to production differences.

If both fluid connections are situated in one component and are also manufactured in one set-up (for example during milling), the tolerance deviations are similar for both bores, for example. Additional tolerances arise after manufacture due to the coatings on the base material which are sometimes necessary. The abovementioned advantage results here again because the fluid connections are situated in the same component and are coated at the same time.

The refrigerant drive according to the invention is configured in particular as a refrigerant compressor, for example as an electromotive scroll compressor, of a motor vehicle. The refrigerant drive is here provided for compressing a refrigerant of a motor vehicle air-conditioning system, and is suitable and configured for this purpose. The refrigerant drive here has an electromotive drive which is controlled and/or regulated by power electronics. In terms of drive technology, the drive is coupled to a compressor head, wherein the compressor head is configured as a scroll compressor as described above. The advantages and embodiments explained with regard to the scroll compressor can analogously also be transferred to the refrigerant drive, and vice versa.

Other features which are considered as characteristic for the invention are set forth in the appended claims.

Although the invention is illustrated and described herein as embodied in a scroll compressor of an electrical refrigerant drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Corresponding parts and sizes are always provided with the same reference symbols in all the drawings.

Figure 1:
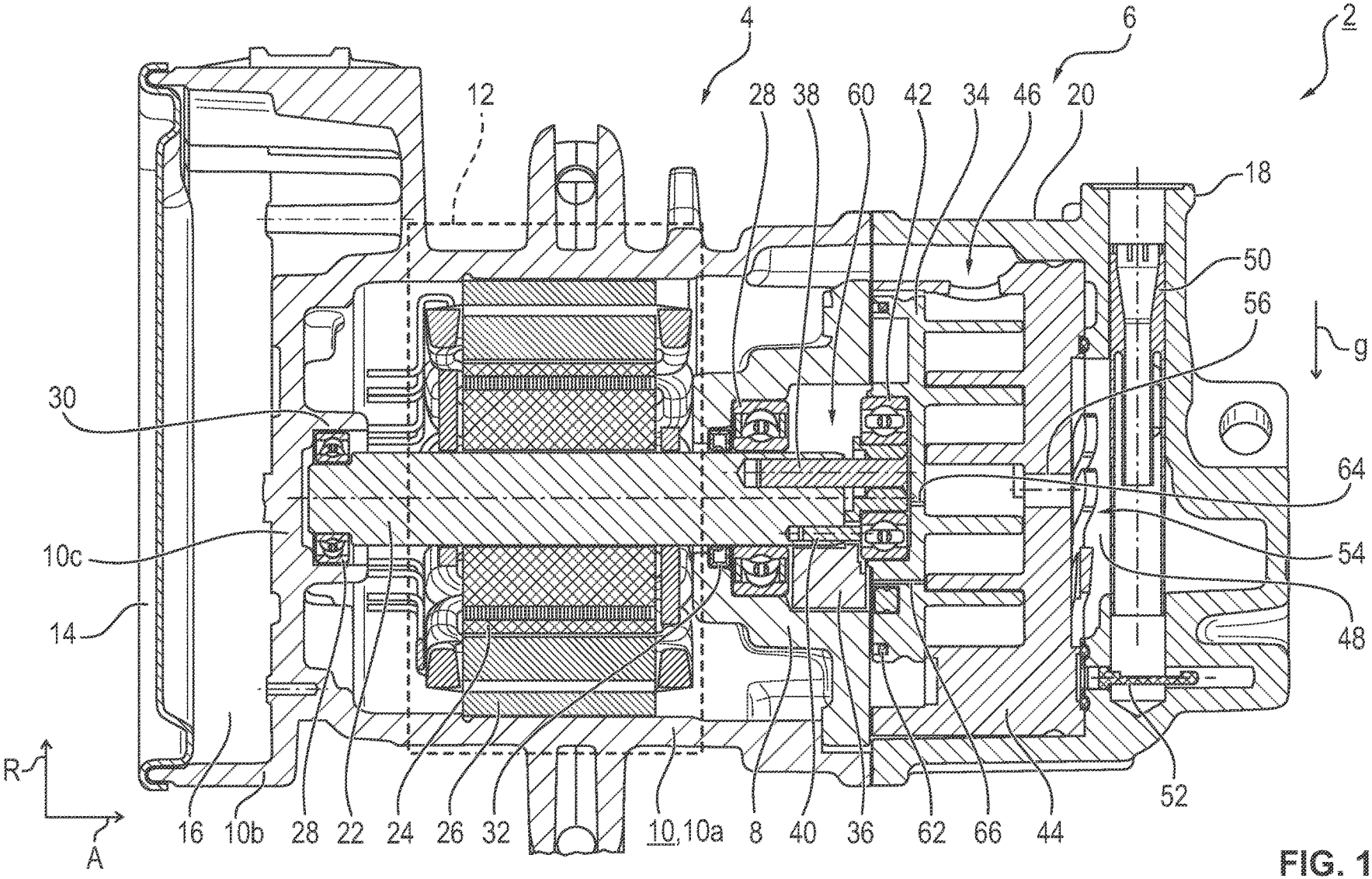
FIG. 1 is a diagrammatic, sectional view of an electrical refrigerant compressor with a scroll compressor with an integrated back pressure system.

Referring now to the figures of the drawings in detail and first, particularly to FIG. 1 thereof, there is shown a refrigerant drive 2 which is preferably installed as a refrigerant compressor in a refrigerant circuit (not shown in detail) of an air-conditioning system of a motor vehicle. The electromotive refrigerant compressor 2 has an electric (electromotive) drive 4 and a scroll compressor 6 coupled to the latter as a compressor head. The scrod compressor 6 is also referred to below as a compressor 6 for short.

The drive 4, on the one hand, and the compressor 6, on the other hand, have, for example, a modular structure such that, for example, the drive 4 can be coupled to different compressors 6. A transition region formed between the modules 4 and 6 has a mechanical interface in the form of a bearing plate 8. The compressor 6 is attached to the drive 4 via the bearing plate 8 so that it can be driven.

The drive 4 has a pot-shaped drive housing 10 with two housing subregions 10*a* and 10*b* which are separated from each other in a fluid-tight manner by a monolithically integrated housing partition wall (bulkhead) 10*c* inside the drive housing 10. The drive housing 10 is preferably produced as a die-cast part from an aluminum material.

The compressor-side housing subregion is designed as a motor housing 10*a* for accommodating an electric motor 12. The motor housing 10*a* is closed on one side by the (housing) partition wall 10*c* and on the other side by the bearing plate 8. The housing subregion situated on the opposite side of the partition wall 10*c* is designed as an electronics housing 10*b* in which power electronics (motor electronics), not shown in detail and which control and/or regulate the operation of the electric motor 12 and hence the compressor 6, are accommodated.

The electronics housing 10*b* is closed on an end side of the drive 4 facing away from the compressor 6 by a housing cover (electronics cover) 14. When the housing cover 14 is open, the power electronics are mounted in an electronics compartment 16 formed by the electronics housing 10*b* and, when the housing cover 14 has been removed, can also be accessed easily for maintenance or repair purposes.

The drive housing 10 has a (suction gas) inlet or suction port (inflow), not shown in detail, for connection to the refrigerant circuit of the air-conditioning system approximately at the level of the electric motor 12. A fluid, in particular a suction gas, flows via the inlet into the drive housing 10, in particular into the motor housing 10*a*. The fluid flows from the motor housing 10*a* through the bearing plate 10 to the compressor 6. The refrigerant is then compressed by means of the compressor 6 and is discharged at a (refrigerant) outlet 18 (outflow) in the bottom of the compressor 6 into the refrigerant circuit of the air-conditioning system.

The outlet 18 is integrally formed on the bottom of a pot-shaped (compressor) housing 20 of the compressor 6. In the connected state, the inlet here forms the low-pressure or suction side and the outlet 18 the high-pressure or discharge side of the refrigerant compressor 2.

The in particular brushless electric motor 12 contains a rotor 24 which is coupled non-rotatably to a motor shaft 22 and is arranged so that it can revolve inside a stator 26. The motor shaft 22 is mounted so that it can rotate or revolve by means of two bearings 28. One bearing 28 is here arranged in a bearing seat 30 which is integrally formed on the bottom of the housing or on the partition wall 10*c* of the drive housing 10. The other bearing 28 is accommodated in the bearing plate 8. The bearing plate 8 here has a sealing ring 32 for sealing with respect to the motor shaft 22.

Figure 2:
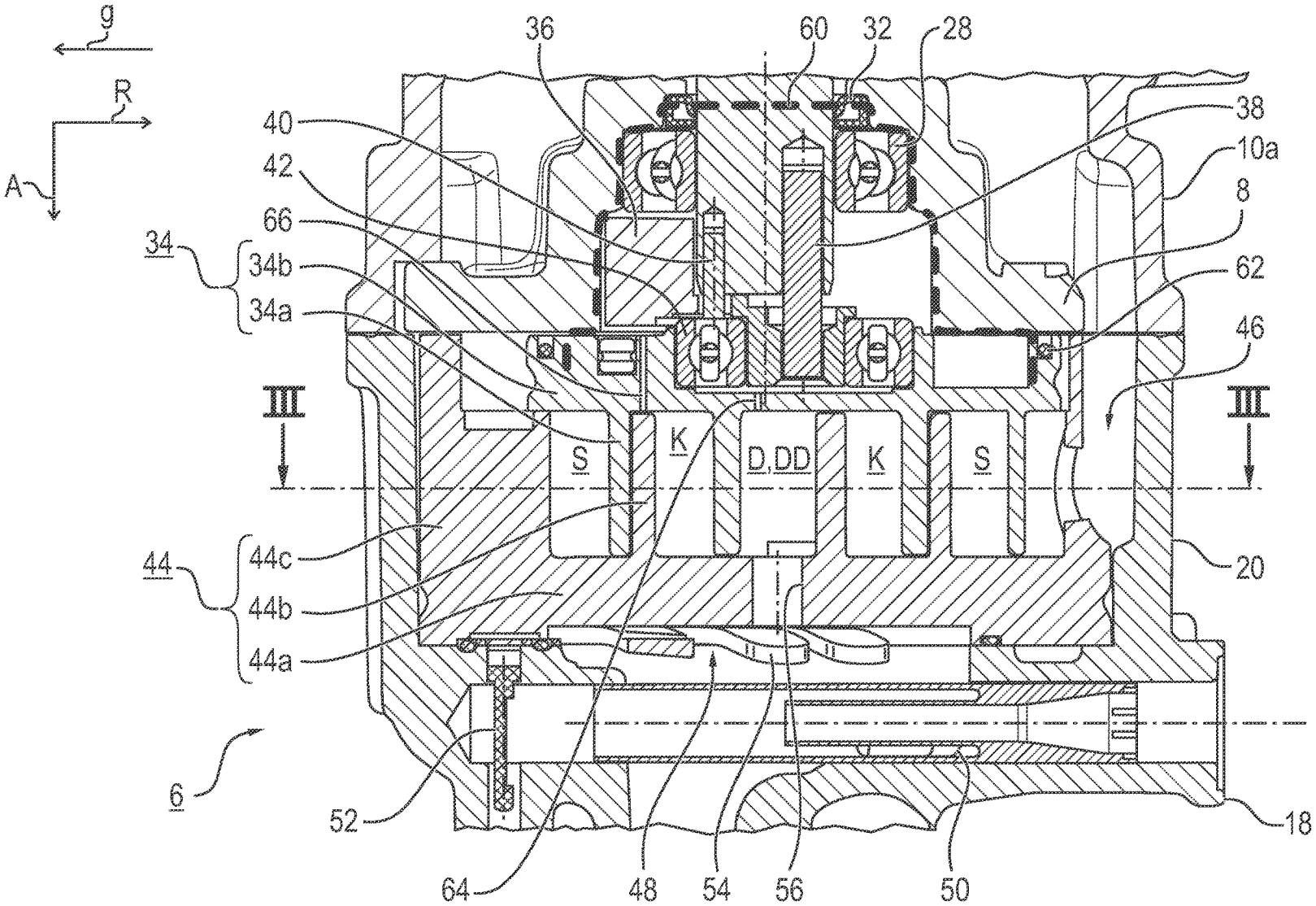
FIG. 2 is a sectional view of a portion of the scroll compressor.

As can be seen relatively clearly in conjunction with FIG. 2, the scroll compressor 6 has a movable scroll (scroll part) 34 arranged in the compressor housing 20. It can be coupled to the motor shaft 22 of the electric motor 12 by means of a balance weight 36 as a swing link or eccentric via two joining pins or shaft journals 38, 40. The shaft journal 38 is here configured as a so-called eccentric pin and the shaft journal 40 as a so-called limiter pin.

The balance weight 36 is mounted in a bearing 42 held in the movable scroll 34. The movable scroll 34 is driven in orbiting fashion during the operation of the scroll compressor 6.

The scroll compressor 6 also has a rigid fixed scroll (scroll part) 44, i.e. one fastened in the compressor housing 20 so that it is fixed to the latter. The two scrolls (scroll parts) 34, 44 engage in each other with their helical or spiral-shaped spiral walls (scroll walls, scroll spirals) 34*a*, 44*a* which rise axially from the respective base plate 34*b*, 44*b*. The spiral walls 34*a*, 44*a* are provided with reference symbols in the drawings only by way of example. The scroll 44 furthermore has a peripheral delimiting wall 44*c* forming the outer periphery.

Figure 8:
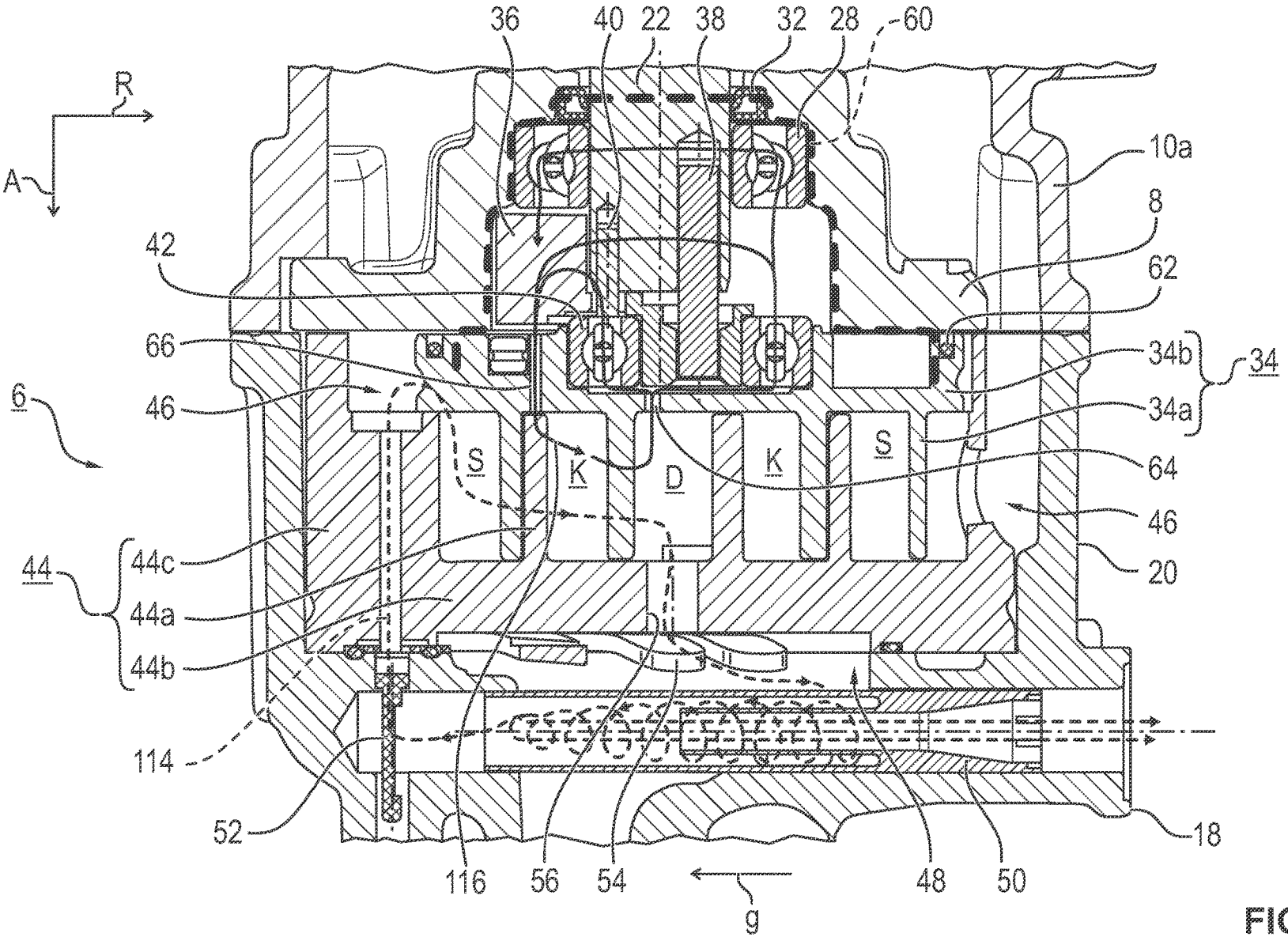
FIG. 8 is a sectional view of a schematic illustration of a primary and a secondary oil circuit in the scroll compressor.

The scrolls 34, 44 are connected to the motor space of the motor housing 10*a* via a suction or low-pressure chamber 46 of the compressor housing 22. When the compressor is operating, the fluid is conveyed from the low-pressure chamber 46 to a high-pressure chamber 48 of the compressor housing 20. An oil separator 50 configured as a cyclone separator is arranged in the high-pressure chamber 48. The separated oil is conveyed back via an oil return line 52 in order to lubricate moving parts (FIG. 8).

A flapper valve (finger spring valve) 54 is arranged between the scroll 44 and the high-pressure chamber 48, i.e. on the bottom of the base plate 44*b*, as a cover or closing part by means of which a central high-pressure-side outlet opening 56 of the scroll part 44 is covered. A flapper valve 54 is here understood in particular to be a non-return valve which opens in the direction of passage purely because of pressure differences on the two sides of the valve and with no other driving means, and which closes again automatically, i.e. covers the outlet opening 56.

The outlet opening 56 is also referred to below as the main outlet port. Two further outlet openings 58 (FIGS. 3A, 3B) are provided as so-called pre-outlets or auxiliary outlets, radially spaced apart from the main outlet port 56. The outlet ports 58 are also referred to below as secondary valve ports.

The flapper valve 54 is provided, on one hand, as the main valve for the outlet opening 56 and, on the other hand, as a pre-outlet valve or auxiliary outlet valve for the outlet openings 58 of the scroll part 44, by means of which over-compression of the refrigerant 2 during operation of the compressor is avoided. This ensures a pressure-regulated discharge of refrigerant from the outlet openings 56, 58.

A back pressure chamber 60, part of a back pressure system which is not described in detail, is situated between the A-side bearing plate 8 (center plate) and the movable scroll 34. The back pressure chamber 60 is delimited in the compressor housing 20 by the base plate 20 of the movable scroll 34. The back pressure chamber 60 extends in some regions into the base plate 34*b* of the movable scroll 34. The back pressure chamber 60 is sealed with respect to the base plate 34*b* by means of a seal 62.

When the refrigerant drive 2 is operating, the refrigerant is introduced into the drive housing 10 via the inlet and from there into the motor housing 10*a*. This region of the drive housing 10 forms the suction or low-pressure side of the scroll compressor 6. The refrigerant can be prevented from penetrating into the electronics compartment 16 by means of the housing partition wall 10*b*. Inside the drive housing 10, the refrigerant/oil mixture is drawn along the rotor 24 and the stator 26 through an opening to the suction or low-pressure chamber 46 of the scroll compressor 6. The mixture of refrigerant and oil is compressed by means of the scroll compressor 6, wherein the oil is used to lubricate the two scrolls 34, 44 such that friction is reduced and consequently efficiency is increased. The oil is also used for sealing in order to prevent the uncontrolled escape of the refrigerant situated between the two scrolls (scroll parts) 34, 44.

The compressed mixture of refrigerant and oil is channeled via the central main outlet port 56 in the base plate 44*b* of the fixed scroll 44 into the high-pressure chamber 48 inside the compressor housing 20. The mixture of refrigerant and oil is set in rotational motion inside the oil separator 50, wherein, because of its increased inertia and increased mass, the heavier oil is channeled to the walls of the oil separator 50 and collects under the effect of gravity g in a lower region of the oil separator 50, while the refrigerant is discharged upward or laterally through the outlet 18. The oil is channeled back to the electric motor 12 by means of the oil return line 52 which opens out in the lower or lateral region of the oil separator 50. In other words, the high-pressure chamber 48 is fluidically connected to the low-pressure side by means of the oil return line 52. The oil return line 52 is configured, for example, as a bypass duct with a choke member in the form of an orifice (FIG. 8).

"Axial" or an "axial direction A" is understood here and below in particular to mean a direction parallel (coaxial) to the axis of rotation of the electric motor 12, i.e. in the longitudinal direction of the refrigerant drive 2. Correspondingly, "radial" or a "radial direction R" is understood here and below to mean a direction, oriented perpendicular (transversely) to the axis of rotation of the electric motor 12, along a radius of the electric motor 12 or the scroll parts 34, 44. "Tangential" or a "tangential direction T" is understood here and below to mean in particular a direction along the periphery of the electric motor (peripheral direction, azimuthal direction) or of the scroll parts 34, 44, i.e. a direction perpendicular to the axial direction and to the radial direction. The direction of gravity is labeled g and illustrated by way of example in the drawings.

In the mounted state of the compressor 6, the spiral body or the spiral wall 34*a* of the movable scroll part 34 engages into the free or intermediate spaces of the spiral wall 44*a* of the fixed scroll part 44. Compressor chambers, the volumes of which are altered when the compressor is operating, are formed between the scrolls 34, 44, i.e. between their scroll walls or scroll spirals 34*a*, 44*a* and the base plates 34*b*, 44*b*. A distinction is also made below between suction chambers S, compression chambers K, and discharge chambers D of the compressor chambers, wherein the respective compression path is identified in FIGS. 3A and 3B by a subscript 1 or 2.

Figure 3A:
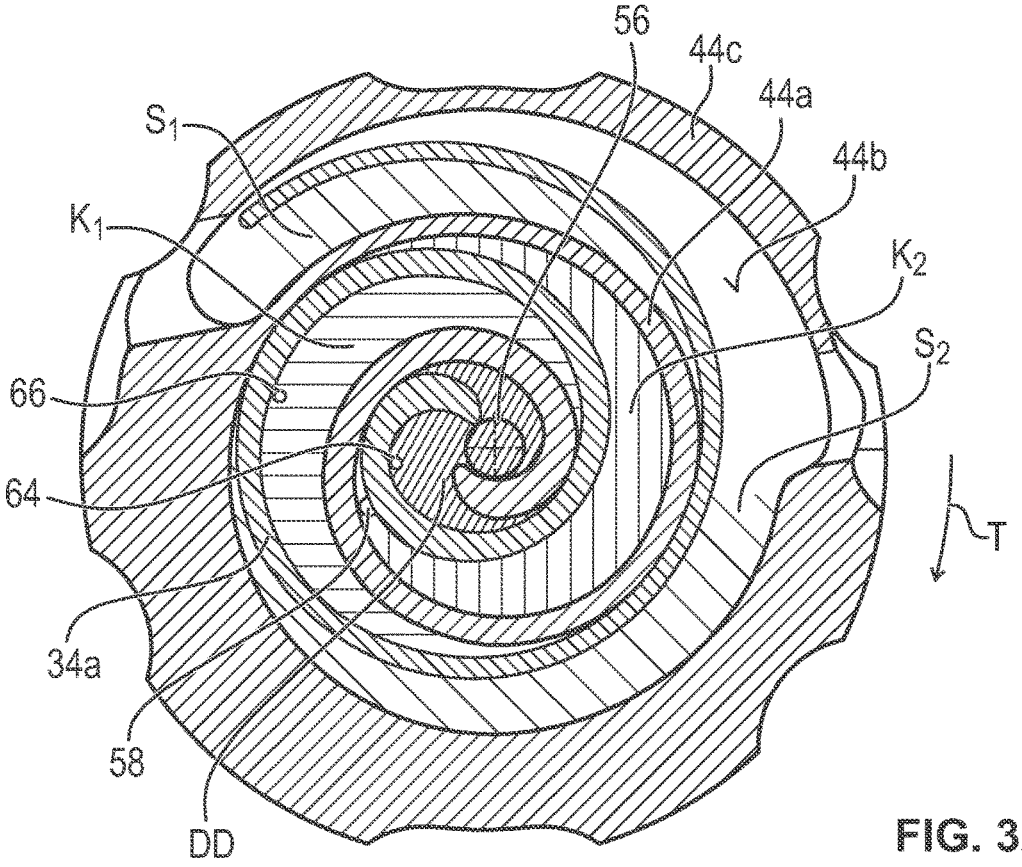
FIGS. 3A, 3B are sectional views of the scroll compressor taken along the line of section III-III shown in FIG. 2 at different points in time of the compression process.
Figure 3B:
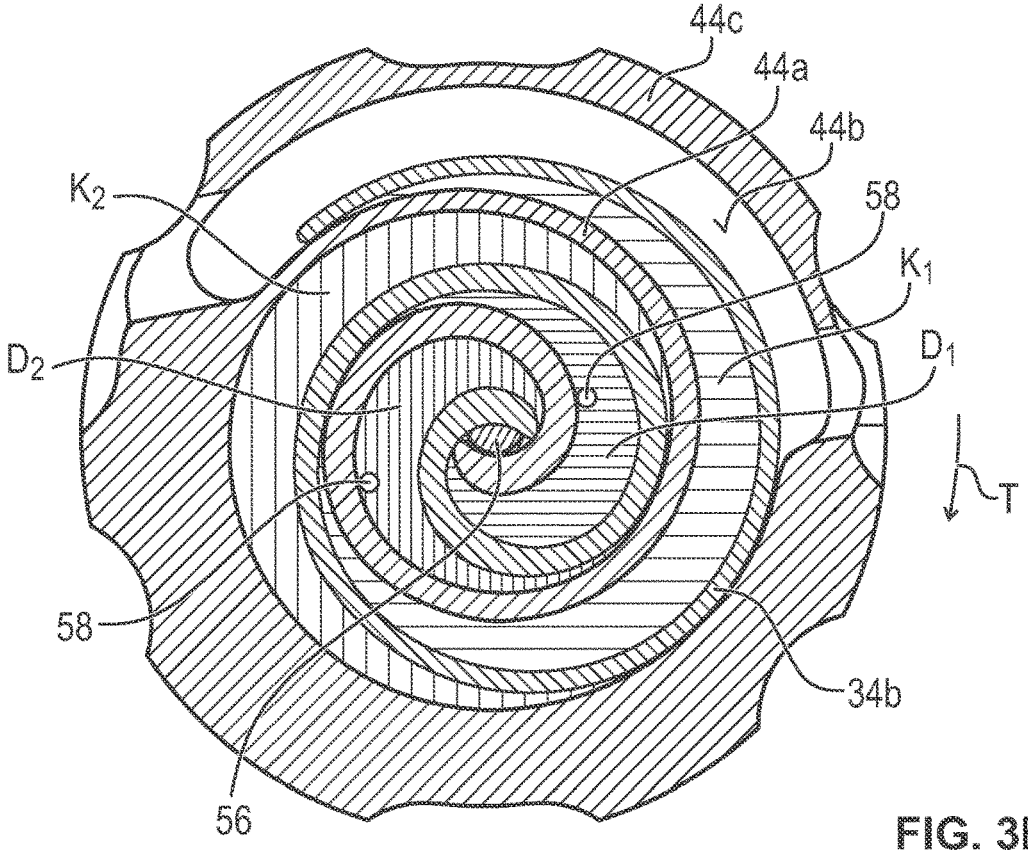

As can be seen in FIG. 3A, the suction chambers S are here open on the low-pressure side, i.e. leading to the low-pressure chamber 46. As soon as the suction chambers S are closed by the orbiting movement of the scroll 34, they become compression chambers K (FIG. 3B), the sickle-shaped volumes of which are successively compressed in the course of the orbiting movement toward the center of the spiral. The angular position of the motor shaft 22 at which the suction chambers S are closed is also referred to below as the 0° position. The two radially innermost compression chambers K here form the discharge chambers D. The discharge chambers D interconnect or merge to form a common outlet chamber DD (FIG. 3*a*) which delivers the compressed refrigerant/oil mixture into the high-pressure chamber 48 by means of the outlet opening 56. The angular position of the motor shaft 22 at which the discharge chambers D merge to form the outlet chamber DD is also referred to below as the merge angle or merging system.

The back pressure system according to the invention enables flexible and effective adjustment of the pressure in the back pressure chamber 60. In the exemplary embodiment of FIGS. 1 to 8, the back pressure chamber 60 is connected for this purpose to the compressor chambers via two fluid connections 64, 66. In the case of a scroll with a scroll length of 720°, it is suitable that more than two fluid connections are provided (utilizing the symmetry). Each fluid connection here connects a different compressor chamber to the back pressure chamber 60, wherein none of the fluid connections 64, 66 communicate with the low-pressure chamber 46. The fluid connections 64, 66 are here introduced into the base plate 34*b* of the orbiting scroll 34 as axial bores.

Figure 4:
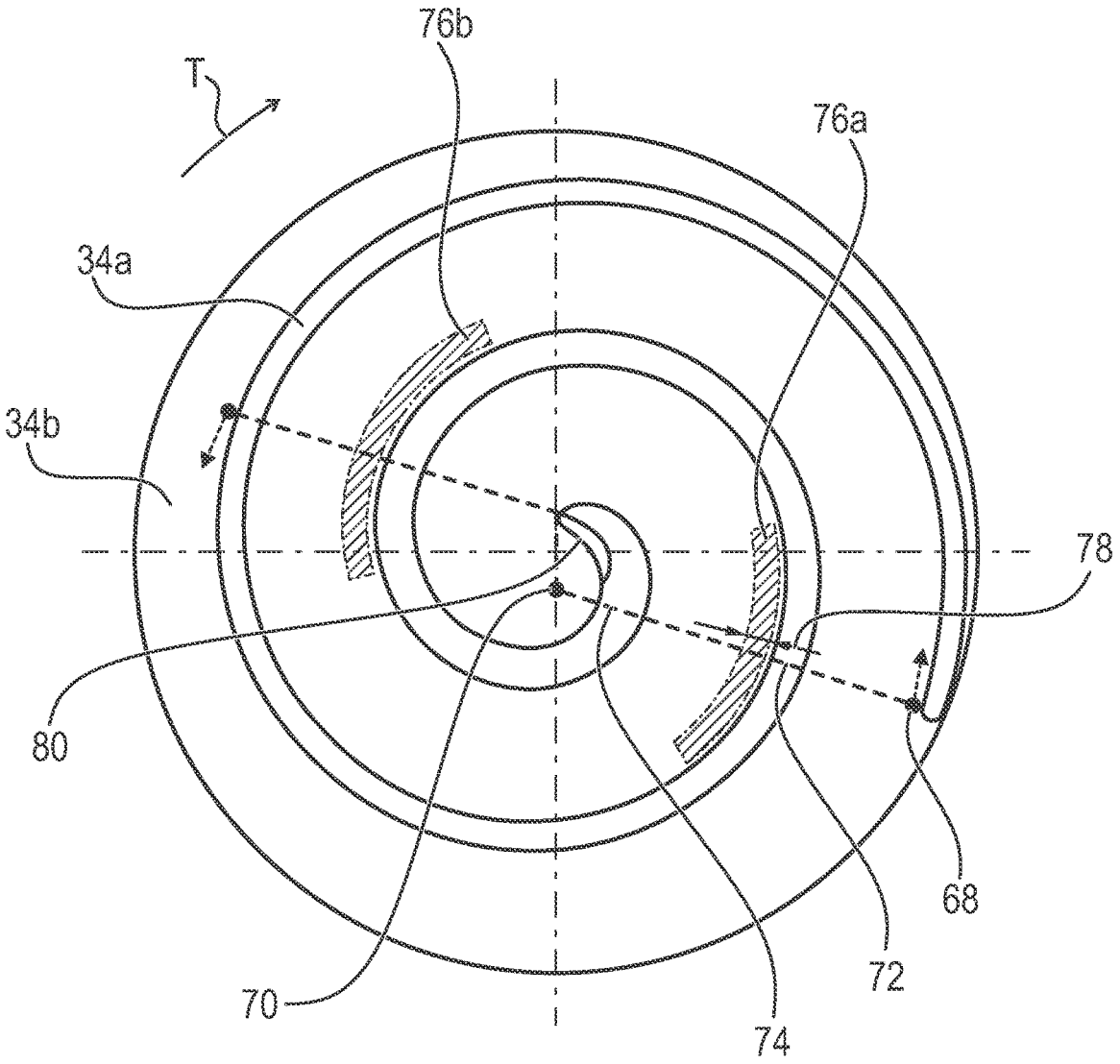
FIG. 4 is a plan view of the orbiting scroll.
Figure 5A:
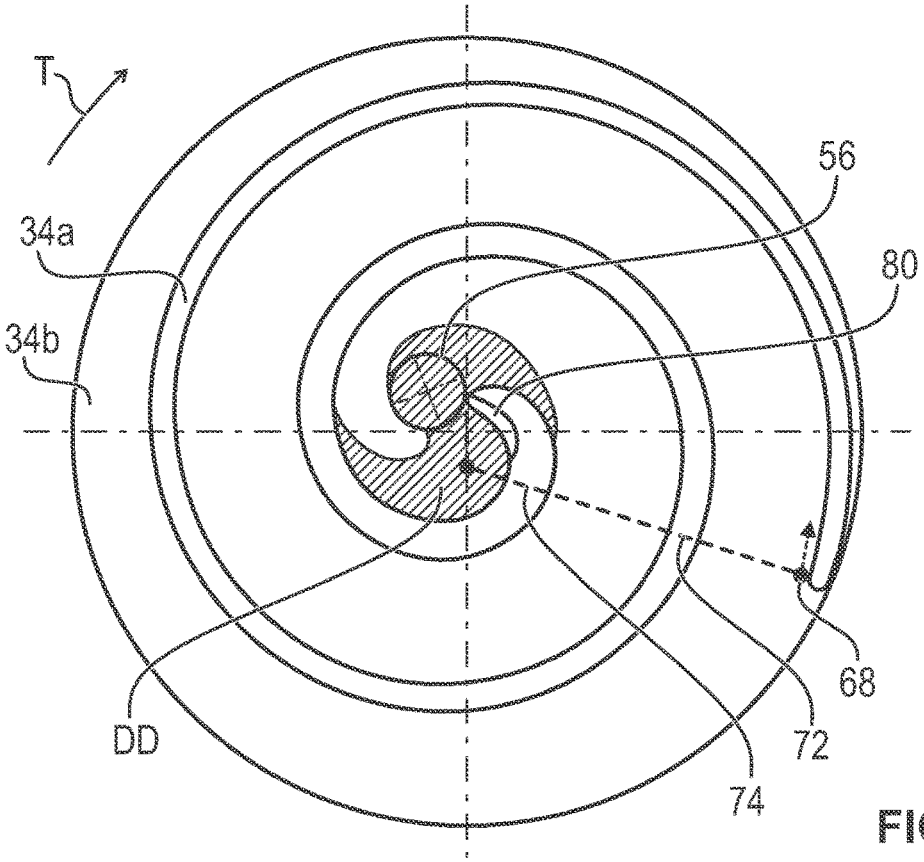
FIGS. 5A, 5B are plan views of the orbiting scroll with a projected compressor chamber.
Figure 5B:
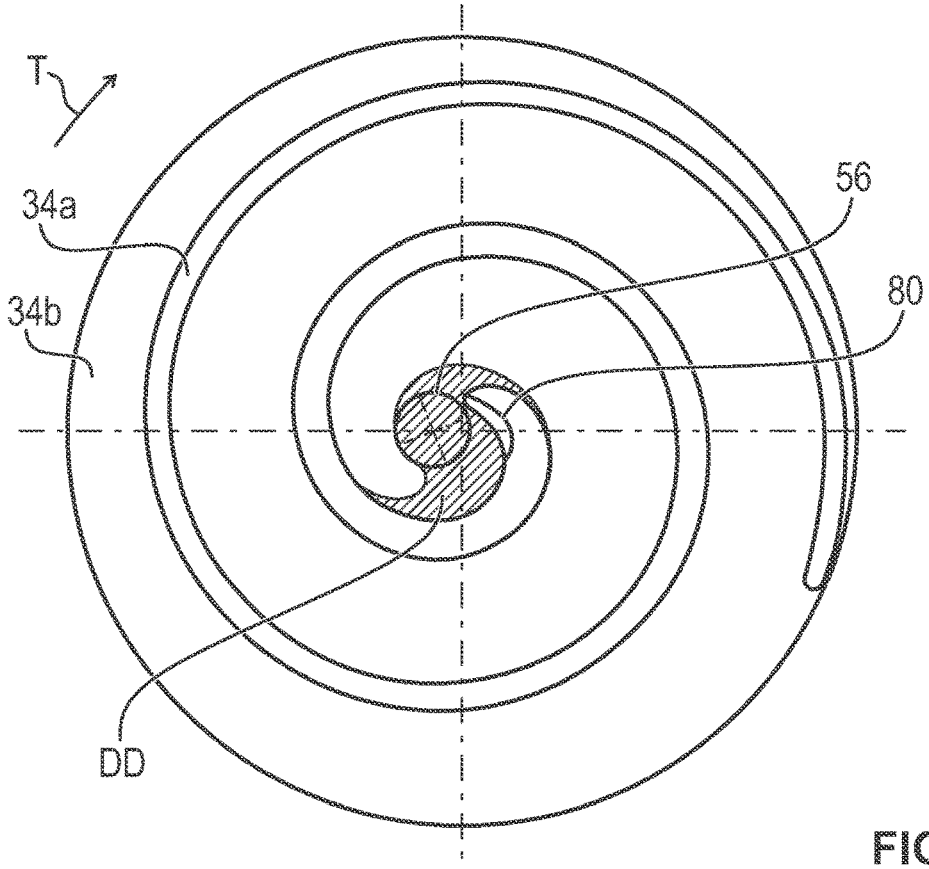

The positioning of the fluid connections 64, 66 is explained in detail below with the aid of FIGS. 4 to 6, wherein the fluid connections 64, 66 are not shown explicitly in FIG. 4, FIG. 5A, and FIG. 5B. The radially outer spiral end 68 of the spiral wall 34*a* is described below with a spiral angle of 0°. If a clock hand were to be turned counterclockwise from the center of the spiral 70 (the center of the spiral is not necessarily at the center of the base plate), it would travel over the whole spiral contour of the spiral wall 34*a* from outside to inside (FIG. 4). The spiral wall section 72 which corresponds to a spiral angle of 360°, and the spiral wall section 74 which corresponds to a spiral angle of 720°, are also shown in FIGS. 4 and 5.

Because it is intended that none of the fluid connections 64, 66 are connected to the suction side, the radially outer fluid connection 66 is arranged in an angular or tolerance range 76*a* which corresponds to a spiral angle of between 360°±45°, i.e. 315° to 405°. The tolerance range 76*a* of the positioning results from the fluid connection 66 being covered by the spiral tip of the fixed scroll 44, i.e. by the axial contact surface of the spiral wall 44*a*, in the course of the orbiting movement. For a spiral wall thickness of up to 90°, a quarter of a shaft revolution can thus be covered.

The fluid connection 66 can be positioned both on the concave and on the convex side of the spiral wall 34*a*, wherein the convex arrangement is arranged offset or mirrored by 180°. This means that a second tolerance range 76*b* is provided for the convex arrangement, within which the radially outer fluid connection 66 is arranged at a spiral angle of between 540°±45°, i.e. 495° to 595°. Depending on which side is chosen, the fluid connection 66 is situated in one of the two compression paths.

A radial spacing 78 of the fluid connection 66 from the flank of the spiral wall 34*a* is here no larger than the wall thickness of the spiral wall 44*a* in the corresponding region because otherwise the fluid connection 66 would come into contact with one of the discharge chambers D.

The fluid connection 64 is here arranged in the region of the radially innermost compressor chamber, i.e. in the region of the discharge chambers D or the outlet chamber DD. The first fluid connection 64 is thus arranged inside the (radially) innermost compressor chamber from which the compressed fluid or the compressed refrigerant is discharged through the main outlet port into the high-pressure chamber.

With regard to the positioning of the inner fluid connection 64, no direct specification of the angle of the spiral angle, such as for example 720°, is possible because the influence of the main outlet port 56 and a tip cut 80 plays an important role here. Furthermore, no "jump" or switch to another compression chamber can take place in the inner region of the scroll compressor 6 when the spacing from the spiral flank is too large because it is already the innermost compression chamber.

The positioning here relates to a positioning region which is characteristic for all scroll compressors, namely in the region of the outlet chamber DD. This region is created after the two innermost discharge chambers D have merged and is continuously fluidically connected to the main outlet port 56.

Figure 6:
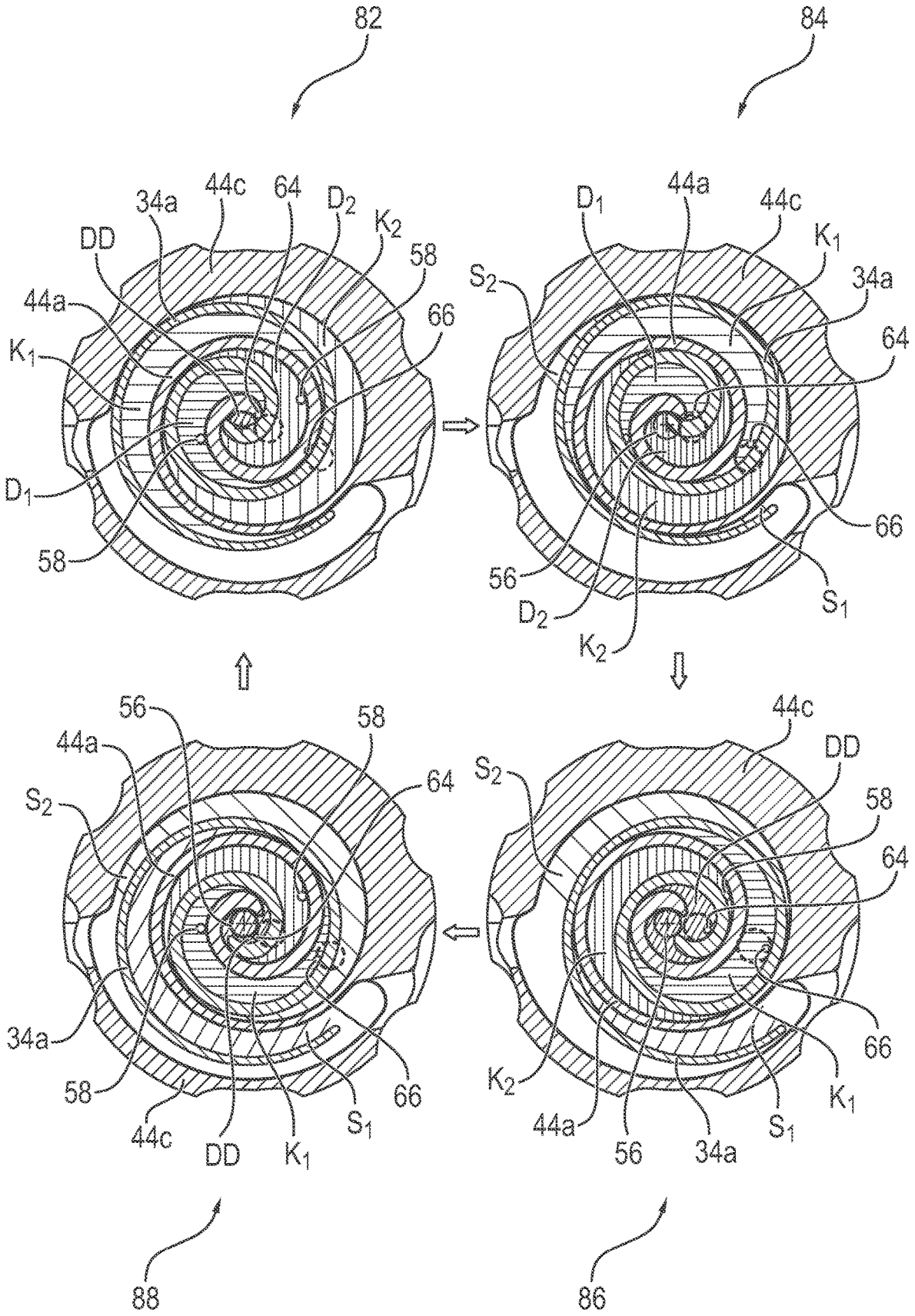
FIG. 6 are a series of sectional views of the compression process of the scroll compressor.

A compressor process of the scroll parts 34, 44 is shown in four partial illustrations 82, 84, 86, 88 in FIG. 6, wherein each partial illustration 82, 84, 86, 88 corresponds to a clockwise 90° revolution of the shaft, i.e. a quarter of the orbiting cycle of the scroll 34. The partial illustrations 82, 84, 86, 88 show a view in section of the scroll compressor 6 showing the fixed scroll 44, wherein the fluid connections 64, 66 are shown as projections, and wherein the circular movement of the fluid connections 64, 66 due to the orbiting movement of the scroll 34 is shown in dashed lines.

In FIG. 6, the movement of the fluid connection 64 intersects the outlet opening 56. In a preferred embodiment, however, the fluid connection 64 is arranged with no overlap such that the movement at no time touches the outlet opening 56.

FIG. 6 shows in the partial illustration 84 the moment shortly before the merging of the discharge chambers D to form the outlet chamber DD. The partial illustration 88 shows this region at a 180° revolution of the shaft. The significant positioning region for the fluid connection 64 in order to be able to monitor the majority of a discharge chamber D and the outlet chamber DD is provided by the silhouette of the outlet chamber DD at 90°±15° after the so-called merge angle, i.e. the angular position at which the discharge chambers D from the partial illustration 84 merge. This region is shown in the illustration in FIG. 5A as a projection onto the base plate 34. An advantageous positioning of the fluid connection 64 is situated in a positioning region of the outlet chamber DD of 180° after the merge angle, as shown in the partial illustration 88 in FIG. 6 and in the projected illustration in FIG. 5B. The positioning region of 180° after the merge angle (FIG. 5B) is here a subregion of the positioning region 90° after the merge angle (FIG. 5A).

This means that the fluid connection 64 is arranged at an angular position within 90° to 180° after the merge angle in the outlet chamber DD. The subsequent (second) fluid connection 66 is arranged at a position which at a spiral angle of 320° to 400° further outward on the spiral 34*a*. The fluid connection 66 is thus situated in a region in which it establishes a connection to the compression chambers K. The fluid connections 64, 66 are here arranged in such a way that the fluid connections 64, 66 are not covered or closed at any time in the orbiting movement of the movable scroll 34.

In other words, preferably at least one fluid connection 64, 66 is open at any point in time.

The two fluid connections 64, 66 are active in respective different compression regions during a compression cycle. In particular, essentially the whole compression cycle (FIG. 6) is actively fluidically connected to the back pressure chamber 60. The diameters of the fluid connections 64, 66 are here weighted with the cross-sectional areas of the associated compressor chambers. This means that the inner fluid connection 64 has a smaller diameter than the subsequent outer fluid connection 66.

Figure 7:
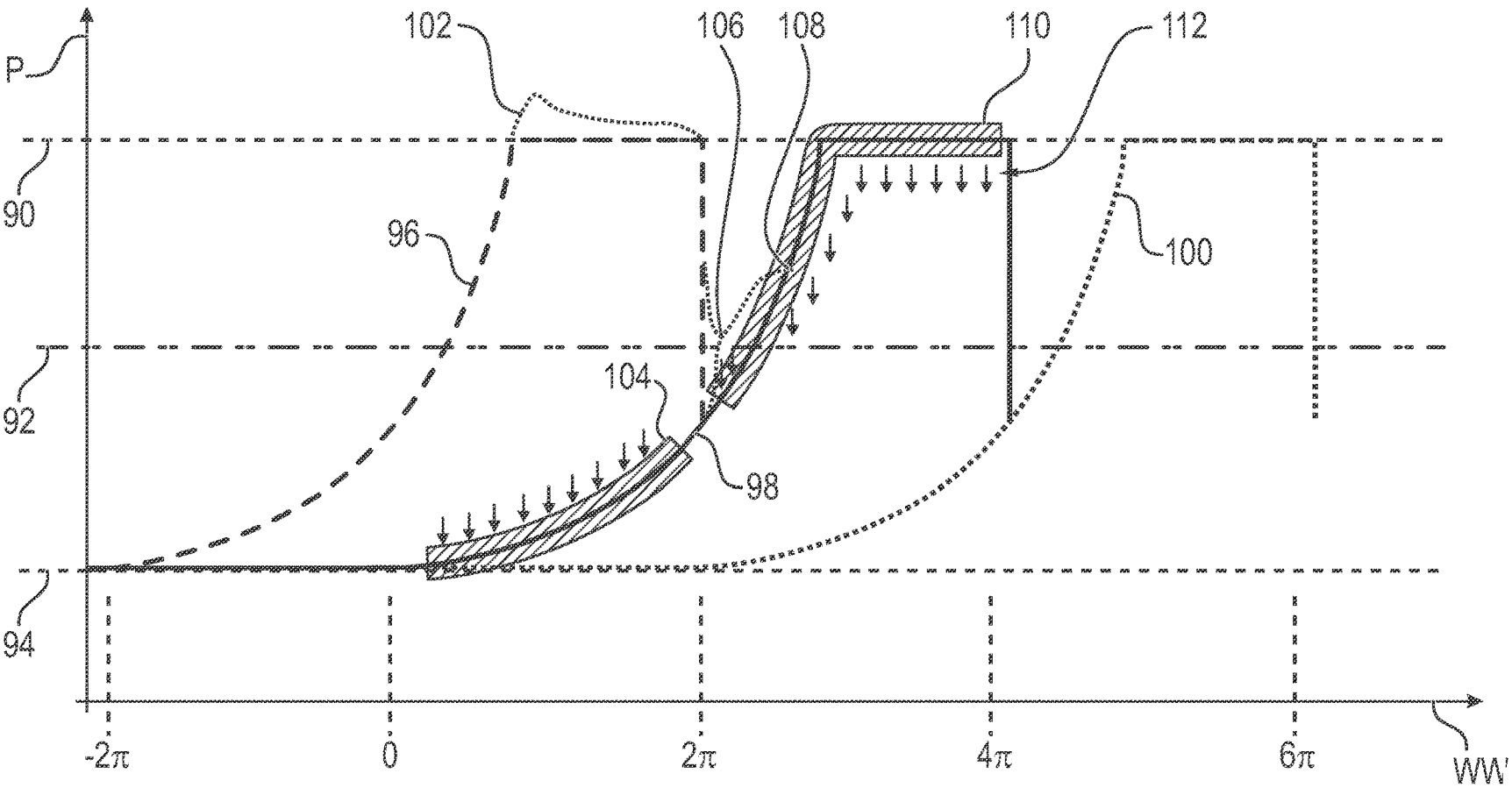
FIG. 7 is a graph showing a shaft angle; pressure graph of the compression process.

The functioning of the back pressure system is explained in detail below with the aid of FIG. 7. In the schematic shaft angle/pressure graph in FIG. 7, a shaft angle WW of the motor shaft 22 is plotted in radians horizontally, i.e. on the abscissa (x-axis) and a pressure p, for example in bars (bar), is plotted on the vertical ordinate axis (y-axis). Three horizontal lines 90, 92, 94 which identify different pressure levels are shown in FIG. 7. The line 90 corresponds to a high-pressure level of the high-pressure chamber 48, the line 92 shows a back pressure level of the back pressure chamber 60, and the line 94 shows a low-pressure level of the low-pressure chamber 46.

Three compression curves 96, 98, 100 for successive compression cycles are shown in the graph in FIG. 7, wherein the compression curve 98 represents a current compression cycle, and wherein the compression curve 96 shows a preceding compression cycle, and the compression curve 100 shows a subsequent compression cycle. The region 102 of the curve 96 which is illustrated by a dotted line corresponds to over-compression.

The outer fluid connection 66 is open in the region labelled 104 of the compression curve 98 such that there is an active fluidic connection between a compression chamber K and the back pressure chamber 60. A backflow phenomenon is shown schematically in the region 106, wherein the merge angle is present, i.e. the discharge chambers D merge to form the outlet chamber DD, at the point 108. The inner fluid connection 64 is open in the region 110 such that an active fluid connection exists between a discharge chamber D or the outlet chamber DD and the back pressure chamber 60.

The two fluid connections 64, 66 are active in respective different compression regions during a compression cycle 98. Depending on the high-pressure level 90 and the low-pressure level 94, a specific back pressure is required in order to ensure the axial force compensation of the back pressure system. Refrigerant mass flows 112 (a refrigerant mass flow also always means a certain proportion of an oil mass flow) are channeled in and out of the back pressure chamber 60 through the two fluid connections 64, 66. The mass flows 112 are shown as vertical arrows in FIG. 7.

The propelling force is here the difference in pressure between the compression chambers K, D, DD and the back pressure chamber. If the pressure of a fluidically connected compression chamber is less than that in the back pressure chamber, refrigerant flows from the back pressure chamber into the compression chamber (the region 104 and start of the region 110). If the reverse is the case, refrigerant flows from the compression chamber into the back pressure chamber.

An internal oil circuit which delivers oil to the bearings 28, 42 in the back pressure chamber 60 and thus lubricates them, is implemented by the fluid connections 64, 66. This is explained in detail below with the aid of FIG. 8.

When the compressor is operating, essentially two oil circuits 114, 116, which are shown schematically in FIG. 8 with the aid of arrows, are formed in the scroll compressor 6. In the oil circuit 114, which is also referred to as the primary circuit, the oil is separated inside an oil separator 50 of the high-pressure chamber 48 and returned to the suction side or low-pressure chamber 46 via a separate path of the return line 52.

A secondary oil circuit (secondary circuit) 116 which ensures the lubrication of the bearings 28, 42 by the oil/refrigerant mixture is created by the fluid connections 64, 66. The circuit 116 is here runs inside the scroll parts 34, 44 in the direction from the fluid connection 66 to the fluid connection 64, i.e. from out to in. In the back pressure chamber 60, the oil is returned back into the outer compression chamber where it effects additional sealing of the leakage gaps.

Figure 9:
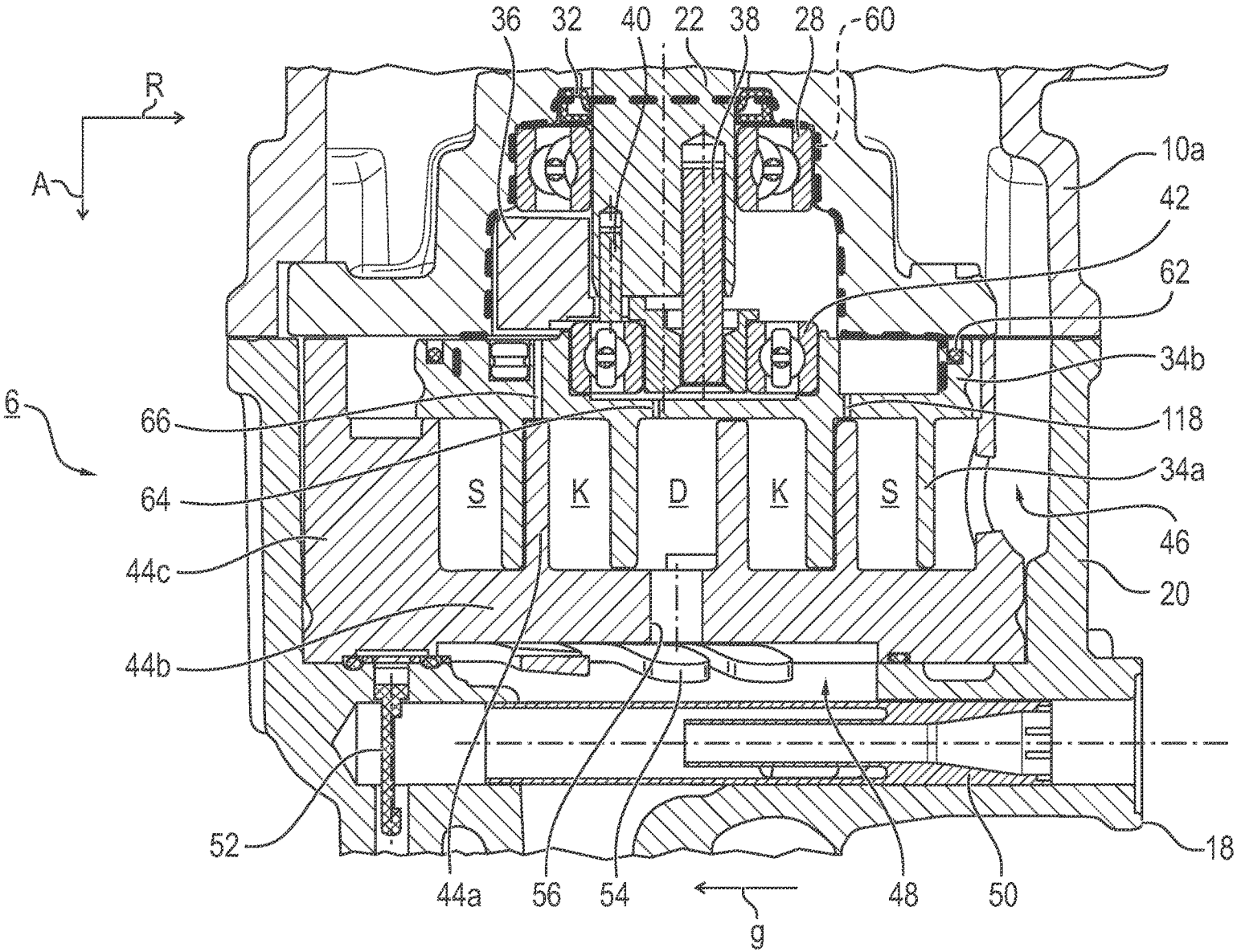
FIG. 9 is a sectional view of a second embodiment of the scroll compressor.

A second exemplary embodiment of the back pressure system or the scroll compressor 6 is shown in FIG. 9. In this embodiment, the scroll 34 has three fluid connections 64, 66, and 118 configured as bores in the base plate 34*b* such that (without utilizing the symmetry) at least one fluid connection is provided every or per 360° of spiral angle. As a result, each compression chamber K, D, DD of the scroll spirals is constantly fluidically connected to the back pressure chamber 60 such that, in the case of correct weighting of the connection diameters or cross-sectional areas of the fluid connections 64, 66, 118 to the axial cross-sectional areas of the compression chambers, a back pressure results in the back pressure chamber 60 which enables optimal axial force compensation.

The fluid connections 66 and 118 are arranged symmetrically relative to each other. In other words, the fluid connections 66, 118 are distributed symmetrically over the compression paths of the scroll compressor 6. As a result, symmetrical recirculation of the mass flow is made possible such that a more uniform pressure distribution is effected in the compressor chambers.

Figure 10:
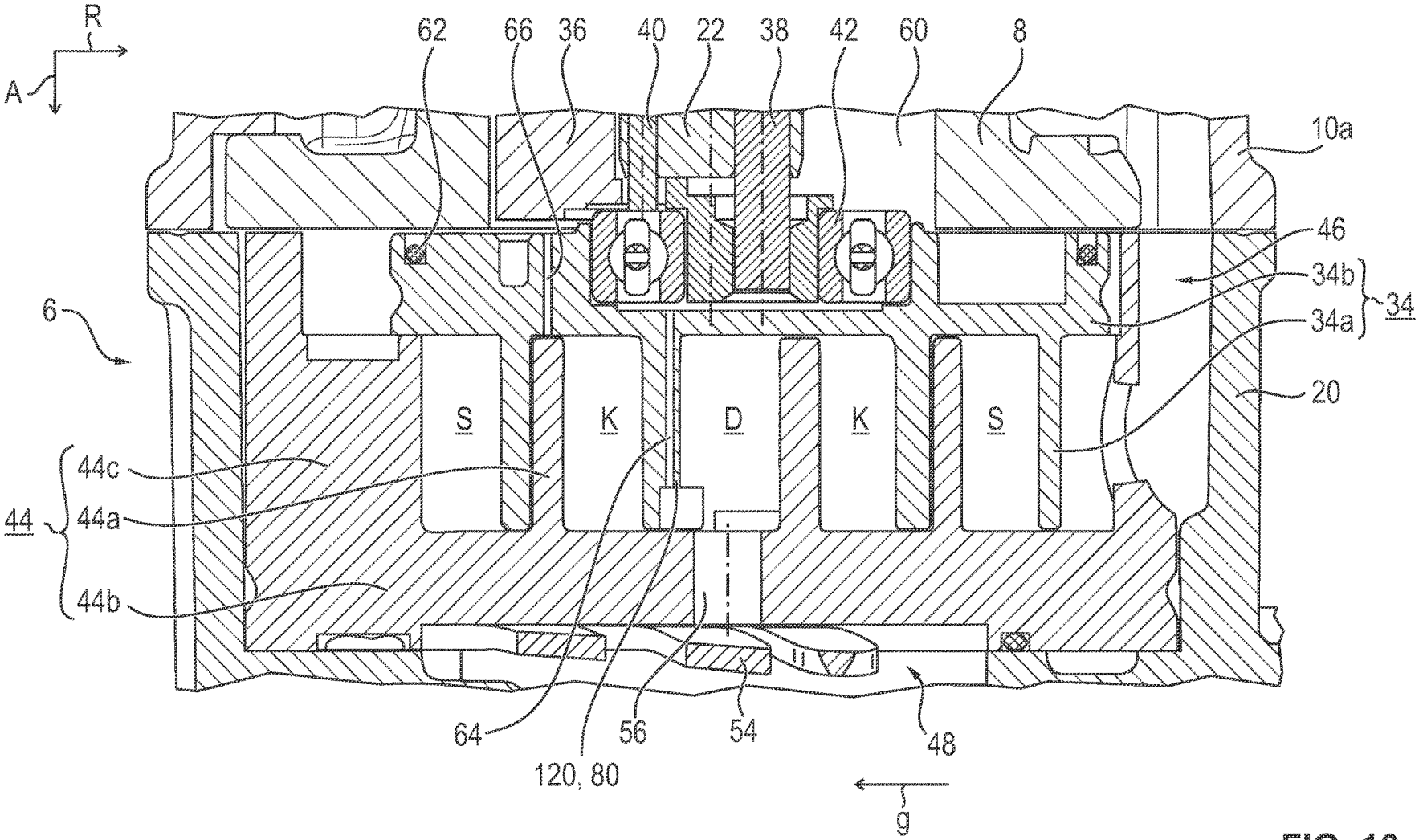
FIG. 10 is a sectional view of a third embodiment of the scroll compressor.
Figure 11:
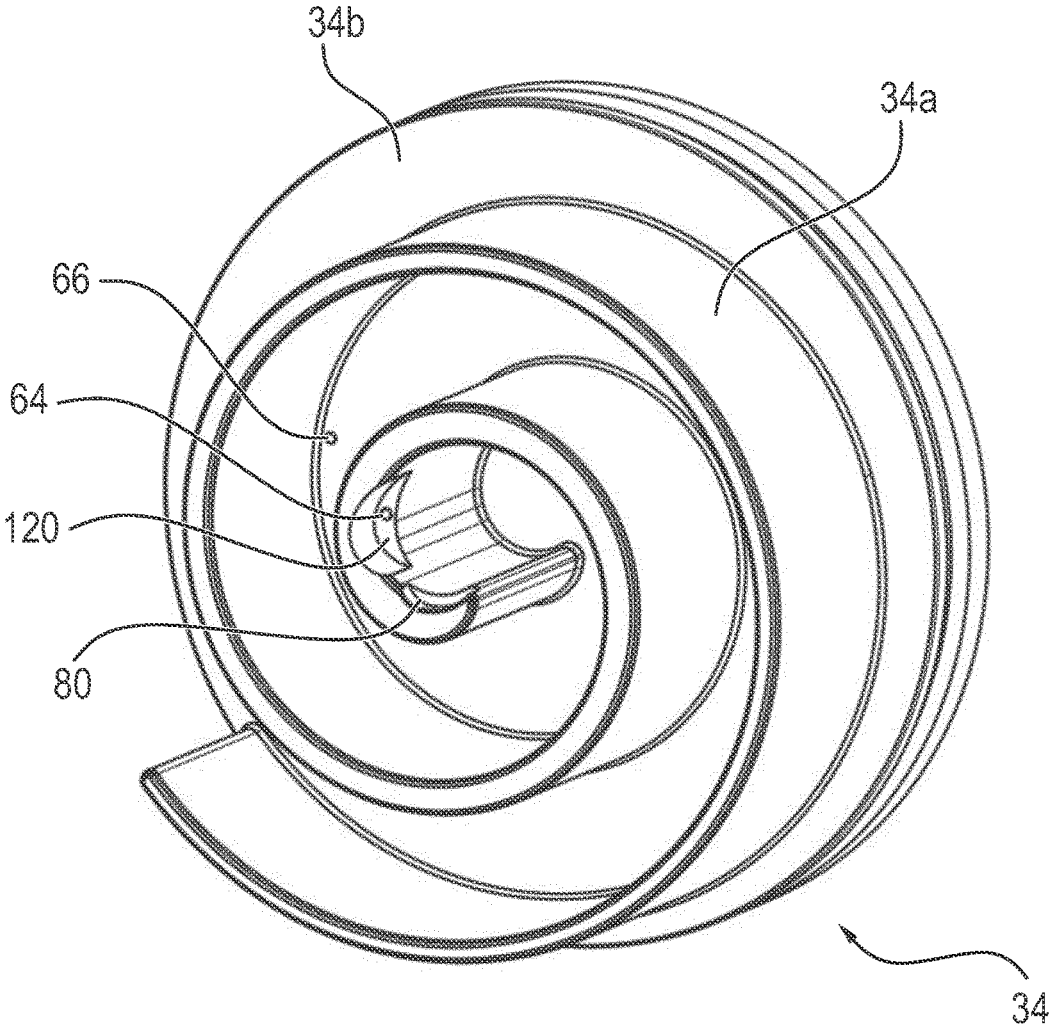
FIG. 11 is a perspective view of the orbiting scroll in FIG. 10.

FIGS. 10 and 11 show a second embodiment of the scroll compressor 6 or the back pressure system in which two fluid connections 64, 66 are provided, wherein the inner fluid connection 64 is introduced as a bore into the spiral wall 34*a* and the outer fluid connection 66 is introduced as a bore into the base plate 34*b*.

The fluid connection 64 is arranged, for example, in the region of the tip cut 80 or a wave guide 120. In the exemplary embodiment shown in FIG. 11, the fluid connection 64 is introduced into the wave guide 120, designed as a stepped axial offset, of the spiral wall 34*a* which is arranged next to the tip cut 80. At no time in the operation of the compressor or the orbiting movement does a spiral flank or spiral wall 44*a* move across the wave guide 120 and the latter is therefore never closed. In other words, the fluid connection 64 is always open. This prevents particles from being pushed in when there is movement across the fluid connection 64.

Figure 12:
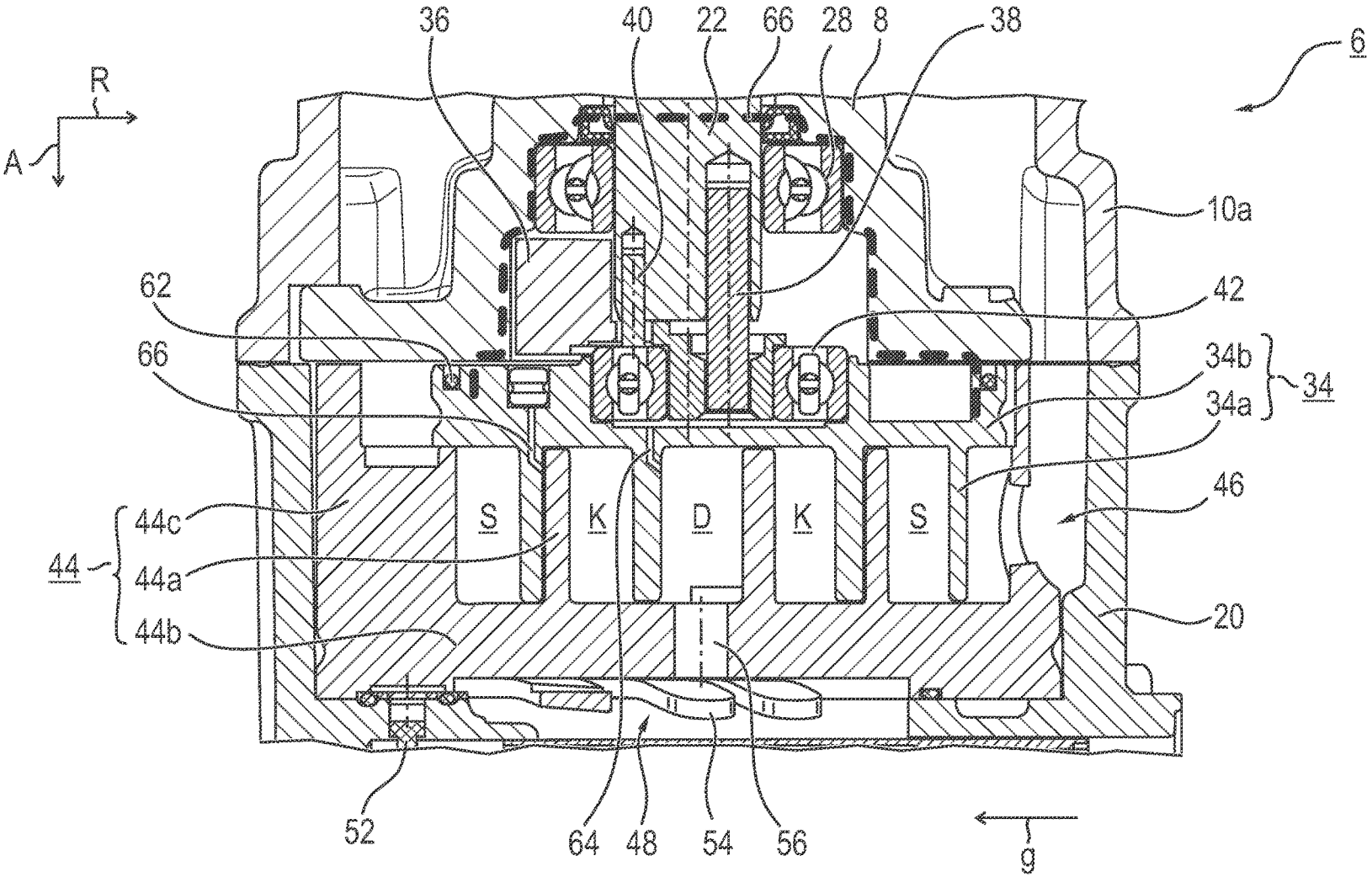
FIG. 12 is a sectional view of a fourth embodiment of the scroll compressor.

A third embodiment of the scroll compressor 6 or the back pressure system is shown in FIG. 12. In this embodiment, the fluid connections 64, 66 are introduced into the radial flanks of the spiral wall 34*a*. The fluid connections 64, 66 are here each configured as two bores which open into each other. The bores which are oriented toward the compressor chambers are here introduced obliquely into the spiral wall 34*a*, wherein these bores each open into an axial or perpendicular bore of the base plate 34*b* which is introduced into the base plate 34*b* from the side on which the back pressure chamber is situated.

Figure 13:
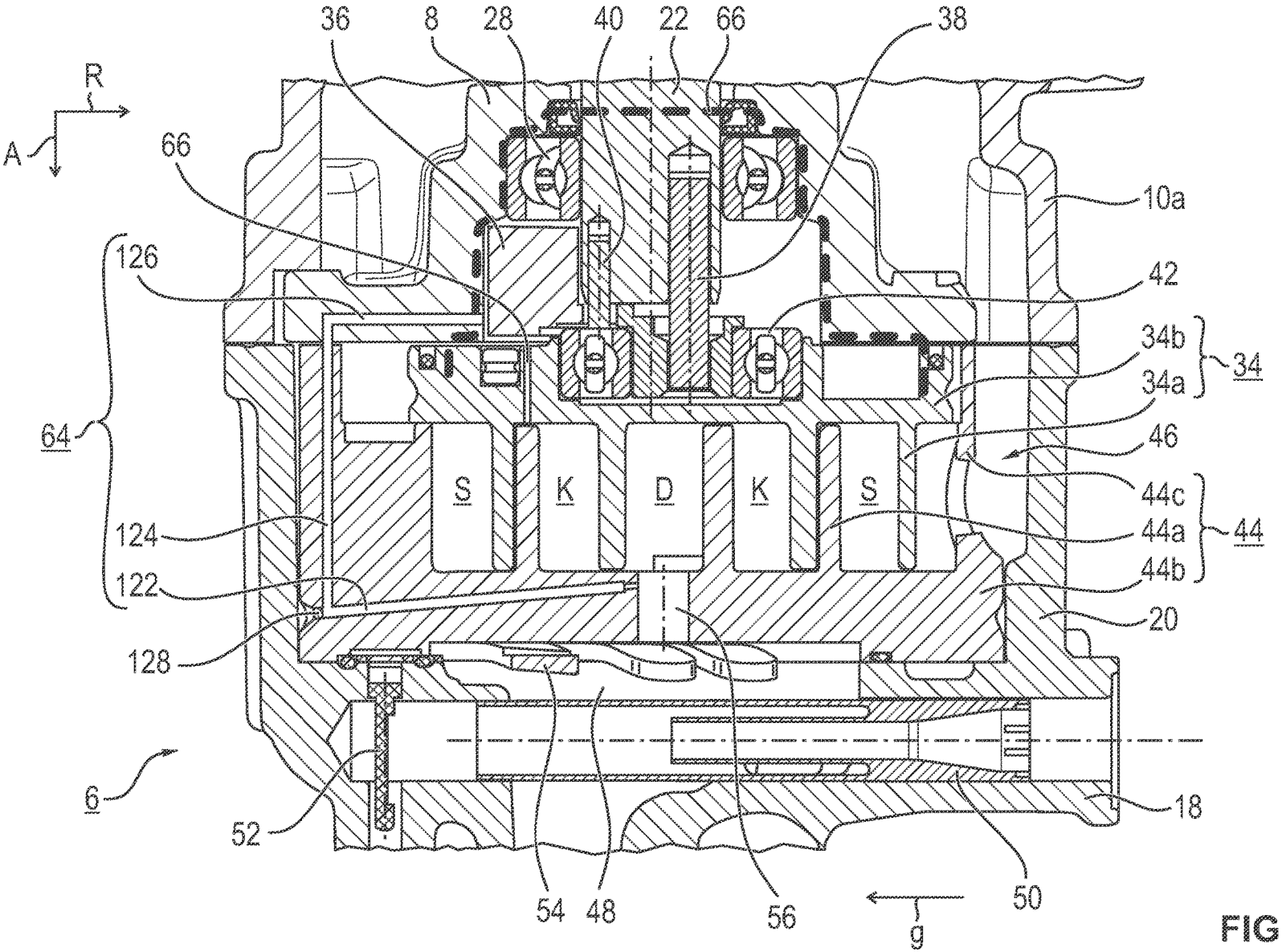
FIG. 13 is a sectional view of a fifth embodiment of the scroll compressor.

FIG. 13 shows a fourth embodiment in which the fluid connection 64 is introduced into the fixed scroll 44 and the fluid connection 66 is introduced into the orbiting scroll 34. The fluid connection 64 is here configured as three bores 122, 124, 126 which open into one another. The first bore is introduced radially and axially obliquely into the base plate 44*b* from its outer periphery and opens into the outlet opening 56. The bore is here closed by means of a plug 128 situated radially on the outside. The axial bore 124 is introduced partly into the delimiting wall 44*c* and partly into the bearing plate 8. The radial bore 126 extends from the back pressure chamber 60 to the bore 124.

Figure 14:
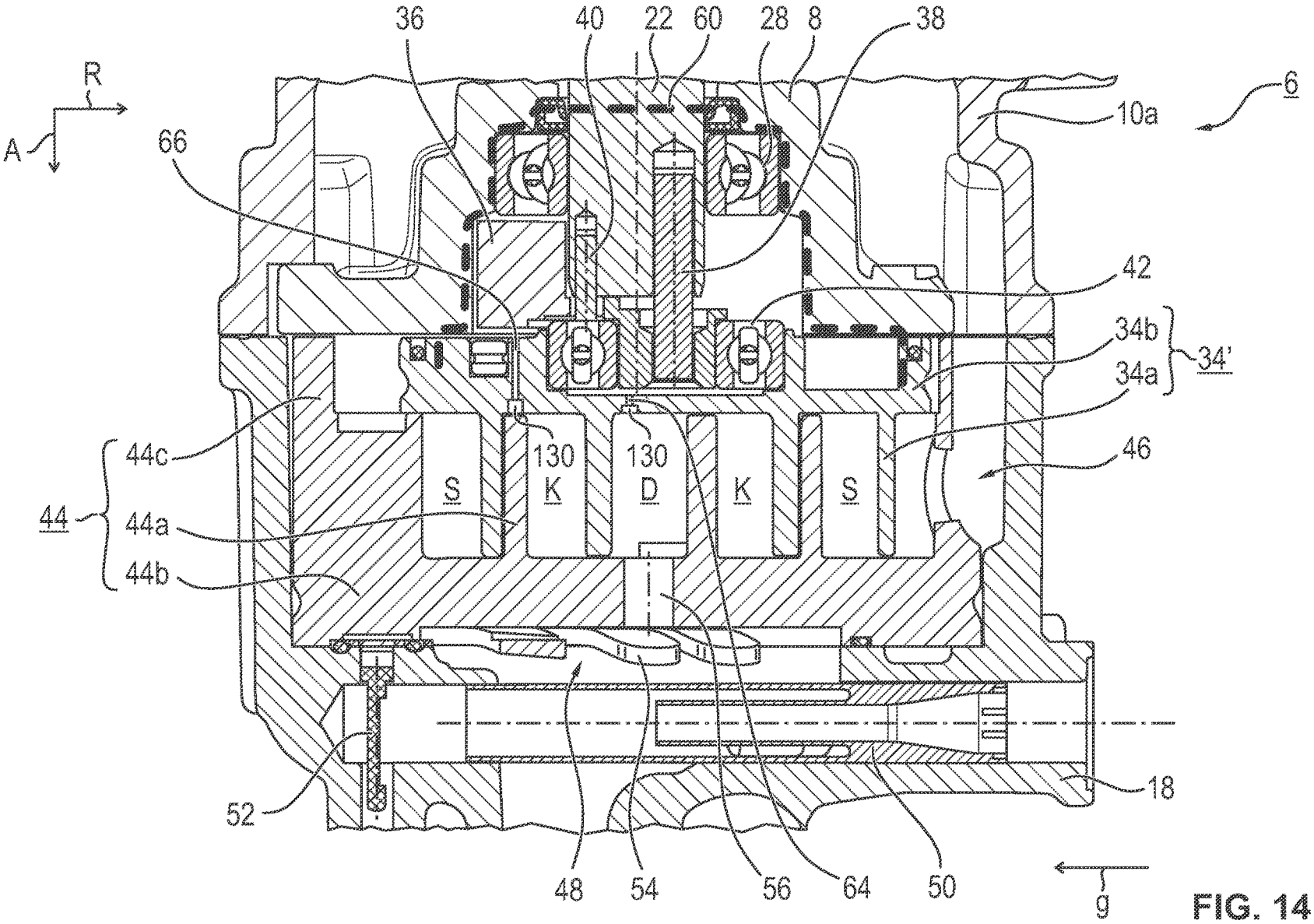
FIG. 14 is a sectional view of a sixth embodiment of the scroll compressor.

A fifth exemplary embodiment of the scroll compressor 6 or the back pressure system is shown in FIG. 14 in which, in order to improve the robustness against particles, a filter component 130 is introduced into each of the fluid connections 64, 66. The filter components 130 are configured, for example, as fine filter fabrics (for example, Betamesh with a 40 μm mesh size). As a result, it is possible for the diameters of the fluid connections 64, 66 to be configured as smaller. For example, the fluid connections 64, 66 can have a diameter of approximately 0.1 mm, wherein the fluid connection 66 preferably has a larger diameter than the fluid connection 64.

Additionally or alternatively, it is, for example, possible to introduce a combination part consisting of a filter and choke geometry into the scroll components 34, 44 in order to improve the robustness against particle clogging.

The invention is not limited to the above-described exemplary embodiments, Instead, other variants of the invention can also be derived therefrom by a person skilled in the art without going beyond the subject of the invention. In particular, all the individual features described in connection with the exemplary embodiments can also be combined with one another in a different fashion without going beyond the subject of the invention.

Thus, all the alternative embodiments can be implemented analogously both in the orbiting scrod 34 and in the fixed scroll 44, or vice versa. The positioning conditions apply for the scroll 44 and the scroll 34 equally. Furthermore, the fluid connections can also be introduced so that they are distributed over the scrolls 34, 44 and are thus implemented with some in the movable scroll 34 and some in the fixed scroll 44. The essential thing is that the fluid connection 64 is arranged in a positioning region of the outlet chamber DD between 90°±15° to 180°±15°, in particular between 90° to 180°, preferably approximately 180°, after the merge angle.

The following is a summary list of reference numerals and the corresponding structure used in the above description of the invention:

2 refrigerant drive
4 drive
6 scroll compressor
8 bearing plate
10 drive housing
10*a* motor housing
10*b* electronics housing
10*c* partition wall
12 electric motor
14 housing cover
16 electronics compartment
18 outlet
20 compressor housing
22 motor shaft
24 rotor
26 stator
28 bearing
30 bearing seat
32 sealing ring
34 scroll
34*a* spiral wall
34*b* base plate
36 balance weight
38 shaft journal
40 shaft journal
42 bearing
44 scroll
44*a* spiral wall
44*b* base plate
440 delimiting wall
46 low-pressure chamber
48 high-pressure chamber
50 oil separator
52 oil return line
54 flapper valve
56 outlet opening/main outlet port
58 outlet opening/secondary valve port
60 back pressure chamber
62 seal
64 fluid connection
66 fluid connection
68 spiral end
70 spiral center
72 spiral wall section
74 spiral wall section
76*a*, 76*b* tolerance range
78 spacing
80 tip cut
82, 84, 86, 88 partial illustration
90, 92, 94 line
96, 98, 100 compression curve
102 region
104, 104' region
106 region
108 point
110, 110' region
112 arrows
114 oil circuit/primary circuit
116 oil circuit/secondary circuit
118 fluid connection
120 wave guide/offset
122, 124, 126 bore
128 plug
130 filter component
A axial direction
R radial direction
T tangential direction
g gravity
S suction chamber
K compression chamber
D discharge chamber
DD outlet chamber
WW shaft angle
P PRESSURE

The invention claimed is:

1. A scroll compressor of an electrical refrigerant drive, the scroll compressor comprising:

a housing having a low-pressure chamber, a high-pressure chamber, compressor chambers and a back pressure chamber;

a fixed scroll having a base plate and a spiral wall, wherein said base plate of said fixed scroll delimits said high-pressure chamber;

a movable scroll having a base plate and a spiral wall engaging in said spiral wall of said fixed scroll and forming said compressor chambers with said fixed scroll, wherein said base plate of said movable scroll delimits said back pressure chamber;

an outlet opening;

a first fluid connection connecting said back pressure chamber to a radially innermost compressor chamber of said compressor chambers which, in a course of a movement of said movable scroll, is coupled to said high-pressure chamber via said outlet opening, wherein said first fluid connection is disposed in a positioning region of said radially innermost compressor chamber between 105° to 195° after a merge angle at which two of said compressor chambers merge to form said radially innermost compressor chamber; and a second fluid connection disposed so that it is offset outward, starting from said first fluid connection, by a spiral angle of 320° to 400° and connects said back pressure chamber to a compressor chamber of said compression chambers which is different from said radially innermost compressor chamber, wherein said first fluid connection having a smaller diameter than said second fluid connection.

2. The scroll compressor according to claim 1, wherein said first fluid connection overlaps with said outlet opening at no time in a movement of said movable scroll.

3. The scroll compressor according to claim 1, wherein neither of said first and second fluid connections is coupled to said low-pressure chamber.

4. The scroll compressor according to claim 1, wherein said first and second fluid connections are disposed such that said first and second fluid connections are collectively closed at no time in a movement of said movable scroll.

5. The scroll compressor according to claim 1, wherein said first fluid connection is introduced into said spiral wall of one of said fixed scroll or said movable scroll.

6. The scroll compressor according to claim 1, wherein said spiral wall of one of said movable scroll or said fixed scroll has a stepped axial offset, and said first fluid connection is introduced in a region of said stepped axial offset.

7. The scroll compressor according to claim 1, wherein said first fluid connection is introduced in said fixed scroll.

8. The scroll compressor according to claim 7, wherein said first fluid connection is introduced transversely into said outlet opening.

9. The scroll compressor according to claim 1, wherein all of said first and second fluid connections are introduced into a same scroll being either said fixed scroll or said movable scroll.

10. An electrical refrigerant drive, comprising:

power electronics;

an electromotive drive; and said scroll compressor according to claim 1 coupled to said electromotive drive as a compressor head.

* * * * *